US010900387B2

(12) United States Patent
Kujak et al.

(10) Patent No.: US 10,900,387 B2
(45) Date of Patent: Jan. 26, 2021

(54) MECHANICAL CAM PHASING SYSTEMS AND METHODS

(71) Applicant: HUSCO AUTOMOTIVE HOLDINGS LLC, Waukesha, WI (US)

(72) Inventors: Michael Kujak, Delafield, WI (US); Austin Schmitt, Hartland, WI (US); Alexander Schlarmann, Waukesha, WI (US)

(73) Assignee: HUSCO Automotive Holdings LLC, Waukesha, WI (US)

( * ) Notice: Subject to any disclaimer, the term of this patent is extended or adjusted under 35 U.S.C. 154(b) by 0 days.

(21) Appl. No.: 16/704,992

(22) Filed: Dec. 5, 2019

(65) Prior Publication Data

US 2020/0182106 A1 Jun. 11, 2020

Related U.S. Application Data

(60) Provisional application No. 62/776,924, filed on Dec. 7, 2018.

(51) Int. Cl.
*F01L 1/344* (2006.01)
*F01L 13/00* (2006.01)

(52) U.S. Cl.
CPC ..... *F01L 1/34403* (2013.01); *F01L 2013/101* (2013.01); *F01L 2820/031* (2013.01)

(58) Field of Classification Search
CPC ..... F01L 1/344; F01L 1/34409; F01L 1/46; F01L 2013/101; F01L 2820/031
USPC ..... 123/90.15, 90.17
See application file for complete search history.

(56) References Cited

U.S. PATENT DOCUMENTS

| | | | |
|---|---|---|---|
| 4,421,074 | A | 12/1983 | Garcea et al. |
| 4,986,801 | A | 1/1991 | Ohlendorf et al. |
| 5,078,647 | A | 1/1992 | Hampton |
| 5,125,372 | A | 6/1992 | Gondek |
| 5,163,872 | A | 11/1992 | Niemiec et al. |

(Continued)

FOREIGN PATENT DOCUMENTS

| | | | |
|---|---|---|---|
| CN | 102562209 | A | 7/2012 |
| DE | 3231503 | A1 | 3/1984 |

(Continued)

OTHER PUBLICATIONS

European Patent Office, Extended European Search Report, Application No. 19214293.3, dated Apr. 22, 2020, 5 pages.

*Primary Examiner* — Jorge L Leon, Jr.
(74) *Attorney, Agent, or Firm* — Quarles & Brady LLP

(57) ABSTRACT

A mechanical cam phasing system includes a stator, a cradle rotor, a first locking mechanism having a first locking feature and a second locking feature, a cage, and a second locking mechanism rotationally coupled to the cradle rotor and selectively moveable between a locking state and a phasing state. In the locking state, a clearance is provided between the cradle rotor and the cage to allow the cradle rotor to rotate relative to the cage and lock the first locking feature or the second locking feature. In the phasing state, the clearance between the cradle rotor and the cage is reduced to ensure rotational coupling between the cradle rotor and the cage in at least one direction, which displaces the first locking feature or the second locking feature relative to the cradle rotor and enables the cradle rotor to rotate relative to the stator.

16 Claims, 22 Drawing Sheets

(56) References Cited

U.S. PATENT DOCUMENTS

| | | | | |
|---|---|---|---|---|
| 5,234,088 | A | 8/1993 | Hampton | |
| 5,235,941 | A | 8/1993 | Hampton | |
| 5,272,937 | A | 12/1993 | Brosowske et al. | |
| 5,305,717 | A | 4/1994 | Wichelhaus | |
| 5,305,719 | A | 4/1994 | Clarke et al. | |
| 5,337,711 | A | 8/1994 | Hampton | |
| 5,588,404 | A | 12/1996 | Lichti et al. | |
| 5,803,030 | A | 9/1998 | Cole | |
| 5,934,263 | A | 8/1999 | Russ et al. | |
| 5,947,070 | A | 9/1999 | Immel et al. | |
| 6,192,842 | B1 * | 2/2001 | Haag | F01L 1/3442 123/90.17 |
| 6,213,071 | B1 | 4/2001 | Lancefield et al. | |
| 6,250,267 | B1 | 6/2001 | Methley | |
| 6,253,720 | B1 | 7/2001 | Lancefield et al. | |
| 6,328,008 | B1 | 12/2001 | Io | |
| 6,363,896 | B1 | 4/2002 | Speier | |
| 6,390,045 | B1 | 5/2002 | Mae et al. | |
| 6,422,188 | B2 | 7/2002 | Pierik | |
| 6,932,036 | B2 | 8/2005 | Aino et al. | |
| 7,086,359 | B2 | 8/2006 | Hayase et al. | |
| 7,201,122 | B2 | 4/2007 | Schmidt | |
| 7,481,191 | B2 | 1/2009 | Watanabe et al. | |
| 7,581,316 | B2 | 9/2009 | Grunow | |
| 7,614,370 | B2 | 11/2009 | Fischer et al. | |
| 7,721,692 | B2 | 5/2010 | Fischer | |
| 8,025,035 | B2 | 9/2011 | Berger | |
| 8,042,504 | B2 | 10/2011 | Berger | |
| 9,228,456 | B2 | 1/2016 | Gross et al. | |
| 9,708,942 | B2 | 7/2017 | Zurface et al. | |
| 10,072,537 | B2 | 9/2018 | Schmitt et al. | |
| 2003/0159670 | A1 | 8/2003 | Simpson et al. | |
| 2010/0024754 | A1 * | 2/2010 | Kameda | F01L 1/34406 123/90.17 |
| 2010/0326386 | A1 * | 12/2010 | Niiro | F01L 1/34403 123/90.17 |
| 2014/0137675 | A1 * | 5/2014 | Suzuki | F01L 13/0036 74/55 |
| 2017/0022855 | A1 * | 1/2017 | Schmitt | F01L 1/34403 |
| 2017/0037749 | A1 | 2/2017 | Berndt | |
| 2017/0175595 | A1 | 6/2017 | Berndt | |
| 2019/0234250 | A1 | 8/2019 | Schmitt et al. | |

FOREIGN PATENT DOCUMENTS

| | | | |
|---|---|---|---|
| DE | 3320835 | A1 | 12/1984 |
| DE | 19846354 | A1 | 4/2000 |
| DE | 19955507 | A1 | 6/2001 |
| DE | 10352362 | A1 | 6/2005 |
| DE | 102009012137 | A1 | 9/2010 |
| DE | 102010027351 | A1 | 1/2012 |
| EP | 0558198 | A1 | 9/1993 |
| EP | 0558199 | A1 | 9/1993 |
| EP | 0558200 | A1 | 9/1993 |
| EP | 1598527 | A2 | 11/2005 |
| EP | 1801367 | A1 | 6/2007 |
| JP | H10153105 | A | 6/1998 |
| JP | 2007092674 | A | 4/2007 |
| JP | 2010001877 | A | 1/2010 |
| JP | 2010014097 | A | 1/2010 |
| WO | 0123713 | A1 | 4/2001 |
| WO | 2012042408 | A1 | 4/2012 |
| WO | 2013020728 | A1 | 2/2013 |

* cited by examiner

MECHANICAL CAM PHASING SYSTEMS AND METHODS

CROSS-REFERENCES TO RELATED APPLICATIONS

The present application is based on, claims priority to, and incorporates by reference herein in its entirety U.S. Provisional Patent Application No. 62/776,924, filed on Dec. 7, 2018, and entitled "Mechanical Cam Phasing Systems and Methods."

STATEMENT REGARDING FEDERALLY SPONSORED RESEARCH

Not Applicable.

BACKGROUND

Conventional two-way clutches can include a driven member and a drive member that may bi-directionally displace with or relative to the driven member. In some applications, a two-way clutch can selectively transition between modes where the driven member and the drive member move in unison, and where the drive member is allowed to move relative to the driven member.

BRIEF SUMMARY

In some aspects, the present disclosure provides a mechanical cam phasing system for an internal combustion engine having a crankshaft and a camshaft. The mechanical cam phasing system including a stator rotationally coupled to the crankshaft and having a first mating surface, a cradle rotor rotationally coupled to the camshaft and having a second mating surface, a first locking mechanism having a first locking feature and a second locking feature, and a cage. The mechanical cam phasing system further including a second locking mechanism rotationally coupled to the cradle rotor for rotation therewith and selectively moveable between a locking state and a phasing state. In the locking state, a clearance is provided between the cradle rotor and the cage to allow the cradle rotor to rotate relative to the cage and lock the first locking feature or the second locking feature by compression between the first mating surface and the second mating surface. Where in the phasing state, the clearance between the cradle rotor and the cage is reduced to ensure rotational coupling between the cradle rotor and the cage in at least one direction. The second locking mechanism is configured to transition between the locking state and the phasing state in response to an input displacement applied thereto. The rotational coupling between the cradle rotor and the cage in the phasing state is configured to displace the first locking feature or the second locking feature relative to the cradle rotor and enable the cradle rotor to rotate relative to the stator.

In some aspects, the present disclosure provides a mechanical cam phasing system for an internal combustion engine having a crankshaft and a camshaft. The mechanical cam phasing system including a stator rotationally coupled to the crankshaft, a cradle rotor rotationally coupled to the camshaft, a locking assembly including a first locking feature and a second locking feature, a cage, and an actuation assembly. The actuation assembly including a slot tube rotationally coupled to the cage through one or more compliance members and including a slot extending axially along a portion thereof. The slot defines a locking region and one or more phasing regions axially separated from the locking region. The actuation assembly further includes a plunger slidably received within the slot tube, a pin extending through the plunger and the slot in the slot tube, the pin being rotationally coupled to the cradle rotor for rotation therewith, and a solenoid configured to selectively displace the plunger and thereby the pin along the slot of the slot tube. The solenoid is configured to selectively displace the pin from the locking region to one of the one or more phasing regions, which, in turn, transitions a rotational relationship between the stator and the cradle rotor from a locked state where relative rotation is inhibited to an unlocked state where relative rotation in a desired direction is enabled.

In some aspects, the present disclosure provides a method for adjusting a rotational relationship between a camshaft and a crankshaft on an internal combustion engine. The camshaft is coupled to a cradle rotor for rotation therewith and the crankshaft is coupled to a stator for rotation therewith. The method includes providing a predetermined interference to a locking assembly via engagement with a cage. The predetermined interference displaces the locking assembly out of engagement with at least one of the stator and the cradle rotor, when the cradle rotor is in an unloaded state. The method further includes actuating a solenoid to a desired position, in response to actuating the solenoid to the desired position, providing a force between the cradle rotor and the cage in order to maintain the cage in engagement with the locking assembly and bias the locking assembly relative to the cradle rotor in one direction, and the biasing of the locking assembly relative to the cradle rotor adjusting the rotational relationship between the cradle rotor and the stator in the one direction.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

Figure 1A:
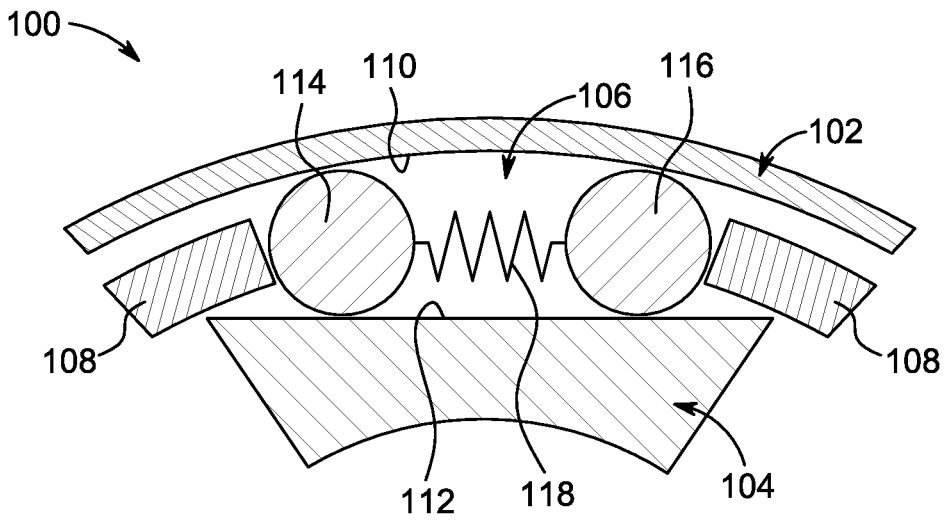
FIG. 1A is a schematic illustration of a two-way clutch with a predetermined interference applied to a locking mechanism and with the locking mechanism in an unloaded state according to one aspect of the present disclosure.

The use herein of the term "axial" and variations thereof refers to a direction that extends generally along an axis of symmetry, a central axis, or an elongate direction of a particular component or system. For example, axially extending features of a component may be features that extend generally along a direction that is parallel to an axis of symmetry or an elongate direction of that component. Similarly, the use herein of the term "radial" and variations thereof refers to directions that are generally perpendicular to a corresponding axial direction. For example, a radially extending structure of a component may generally extend at least partly along a direction that is perpendicular to a longitudinal or central axis of that component. The use herein of the term "circumferential" and variations thereof refers to a direction that extends generally around a circumference or periphery of an object, around an axis of symmetry, around a central axis, or around an elongate direction of a particular component or system.

FIGS. 1A-1D illustrate a two-way clutch 100 (e.g., a mechanical cam phasing system 100) according to the present disclosure. The two-way clutch 100 may include a stator 102, a cradle rotor, 104, a locking mechanism 106, and a cage 108. In some non-limiting examples, the stator 102 may be coupled to a device that is configured to input energy thereto, such that the stator 102 travels in unison with the device. For example, the stator 102 may be coupled to a crankshaft of a motor (e.g., an electric motor, an internal combustion engine, etc.) for rotation therewith. The cradle rotor 104 may be coupled to another component (e.g., a camshaft) that is also coupled to the device and is driven by the stator 102, but may be allowed to displace with or relative to the stator 102.

Generally, the locking mechanism 106 may be arranged between the stator 102 and the cradle rotor 104. The locking mechanism 106 may be configured to selectively allow relative motion between the stator 102 and the cradle rotor 104. For example, the locking mechanism 106 may be movable between a locked position and an unlocked position. In the unlocked position, the locking mechanism 106 may allow the cradle rotor 104 to displace relative to the stator 102 in a desired direction. In the locked state, the locking mechanism 106 may inhibit relative motion between the stator 102 and the cradle rotor 104 in at least one direction.

In the illustrated non-limiting example, the stator 102 may include a first mating surface 110 arranged adjacent to the locking mechanism 106. The cradle rotor 104 may include a second mating surface 112 arranged adjacent to the locking mechanism 106. In the illustrated non-limiting example, the locking mechanism 106 may be arranged between the first mating surface 110 and the second mating surface 112. The locking mechanism 106 may include a first locking feature 114 and a second locking feature 116 biased apart from one another by a biasing element 118. In some non-limiting examples, the first and second locking features 114 and 116 may be in the form of bearings. In some non-limiting examples, the first and second locking features 114 and 116 may be in the form of roller bearings. In some non-limiting examples, the first and second locking features 114 and 116 may take any form configured to conform to a cavity between the first mating surface 110 and the second mating surface 112 (e.g., wedges).

In operation, the cradle rotor 104 may be subjected to an outside force that applies a load onto the locking mechanism 106. For example, a component of the device to which the cradle rotor 104 is coupled may exert the outside force on the cradle rotor 104. In some non-limiting examples, the outside force may occur in more than one direction. In some non-limiting examples, the outside force applied to the cradle rotor 104 may cyclically vary between a first direction and a second direction.

In some non-limiting examples, when the outside force is exerted on the cradle rotor 104, the corresponding load applied to the locking mechanism 106 can compress either the first locking feature 114 or the second locking feature 116, depending on the direction of the outside force, between the stator 102 and the cradle rotor 104. This compression applied to the locking mechanism 106 may substantially prevent either the first locking feature 114 or the second locking feature 116 from being transitioned between the locked and unlocked positions. That is, the compression of the locking mechanism 106 between the stator 102 and the cradle rotor 104 may effectively "lock" the locking mechanism 106 in a direction that corresponds with the direction of the outside force and substantially prevent the relative rotation between the cradle rotor 104 and the stator 102 in this direction. Thus, for certain operating conditions, the outside force applied to the cradle rotor 104 may place the locking mechanism 106 in a loaded state in which the cradle rotor 104 is prevented from rotating relative to the stator 102 in a direction that corresponds with the outside force.

In general, the cage 108 may provide a predetermined interference that may be applied to the locking mechanism 106 to combat the undesired "locking" thereof in the loaded state and enable relative rotation between the stator 102 and the cradle rotor 104 with minimal input force. In some non-limiting examples, the cage 108 may be placed in engagement with the locking mechanism 106, such that the cage 108 provides a predetermined interference to the locking mechanism 106. For example, the cage 108 may be designed to provide the predetermined interference on the locking mechanism 106, when the locking mechanism 106 is in an unloaded state (i.e., the outside force is not applied to the cradle rotor 104). In some non-limiting examples, the predetermined interference provided by the cage 108 may displace the locking mechanism 106 away from at least one of the stator 102 and the cradle rotor 104 such that a gap exists therebetween. In some non-limiting examples, the predetermined interference provided by the cage 108 may displace the locking mechanism 106 away from both of the stator 102 and the cradle rotor 104 such that a gap exists therebetween.

In some non-limiting examples, the two-way clutch 100 may be applied in a rotating two-way clutch application. For example, the two-way clutch 100 may be applied in a mechanical cam phasing application, where the stator 102 may be rotatably coupled to a crankshaft on an internal combustion engine and the cradle rotor 104 may be rotatably coupled to a camshaft on an internal combustion engine.

One non-limiting example of the operation of the two-way clutch 100 in a mechanical cam phasing application will be described with reference to FIGS. 1A-1D. Generally, during operation, outside forces may be exerted on the cradle rotor 104. For example, the cradle rotor 104 may be subjected to cam torque pulses originating from the intake and exhaust valves acting on the camshaft. The cam torque pulses acting on the cradle rotor 104 may vary in direction and magnitude (e.g., cyclically) during operation of the internal combustion engine.

FIG. 1A illustrates the two-way clutch 100 with the locking mechanism 106 in an unloaded state. That is, there is no outside force (e.g., cam torque pulse) applied to the cradle rotor 104. With the locking mechanism 106 in the unloaded state, the cage 108 is designed to engage the locking mechanism 106 such that a predetermined interference is applied thereto. For example, the cage 108 can displace the first locking feature 114 and the second locking feature 116 away from at least one of the first mating surface 110 and the second mating surface 112. In this way, for example, both of the first and second locking features 114 and 116 may be capable of being displaced (i.e., not "locked") by the cage 108. In some non-limiting examples, the predetermined interference may provide a gap between the first locking feature 114 and the second locking feature 116 and at least one of the first mating surface 110 and the second mating surface 112. In some non-limiting examples, the predetermined interference may provide a gap between the first locking feature 114 and the second locking feature 116 and both of the first mating surface 110 and the second mating surface 112. In any case, the predetermined interference provided by the cage 108 may ensure that each of the first locking feature 114 and the second locking feature 116 remains unlocked for a respective half of the cam torque cycle as will be described herein.

Figure 1B:
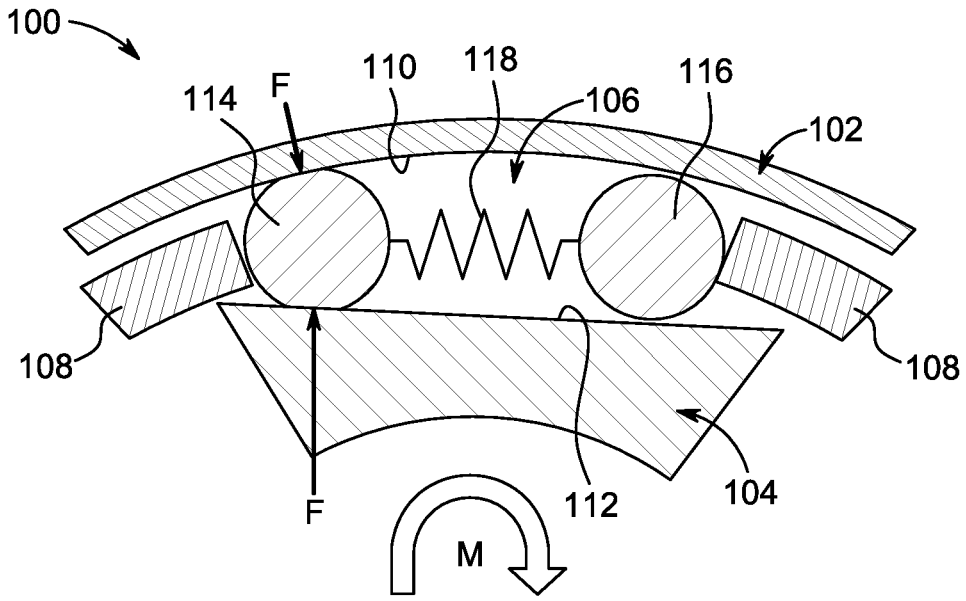
FIG. 1B is a schematic illustration of the two-way clutch of FIG. 1A with an outside force applied in a first direction and a first locking member of the locking mechanism in a compressed state.

During operation, an outside force may be applied to the cradle rotor 104 in a first direction, as illustrated in FIG. 1B. In the illustrated non-limiting example, the outside force may be a torque pulse acting on the cradle rotor 104 in a clockwise direction. When the outside force is applied to the cradle rotor 104 in the first direction, compressive forces F may apply load to the first locking feature 114. For example, the compressive forces F may result from contact between the first locking feature 114 and both of the first mating surface 110 and the second mating surface 112. The compressive forces applied to the first locking feature 114 as a result of the outside force on the cradle rotor 104 may "lock" the first locking feature 114. That is, in this loaded state, the first locking feature 114 may prevent rotation of the cradle rotor 104 in the first direction relative to the stator 102. The second locking feature 116, however, may be supported by the cage 108 and the predetermined interference provided thereby can maintain a clearance, or gap, between the second locking feature 116 and at least one of the first mating surface 110 and the second mating surface 112. Thus, the predetermined interference can maintain the second locking feature 116 in an "unlocked" state, where it is not compressed between the first and second mating surfaces 110 and 112 and relative rotation may be achievable in the second direction between the stator 102 and the cradle rotor 104 with minimal input force.

Figure 1C:
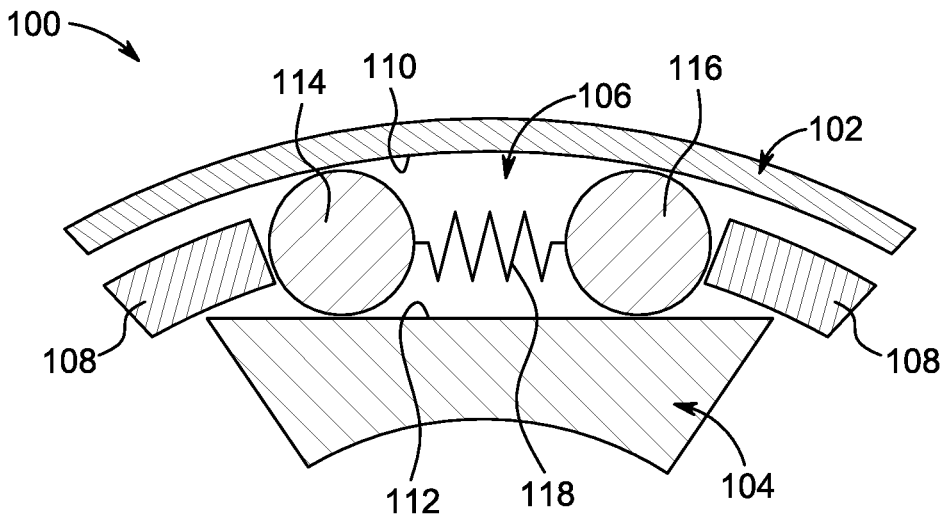
FIG. 1C is a schematic illustration of the two-way clutch of FIG. 1B with the outside force in the first direction removed and the locking mechanism in an unloaded state.

FIG. 1C illustrates the two-way clutch 100 once the outside force applied to the cradle rotor 104 in the first direction is removed. With the outside force in the first direction removed, the compressive forces on the first locking feature 114 can be removed and the locking mechanism 106 may return to the unloaded state via the predetermined interference provided by the cage 108.

Figure 1D:
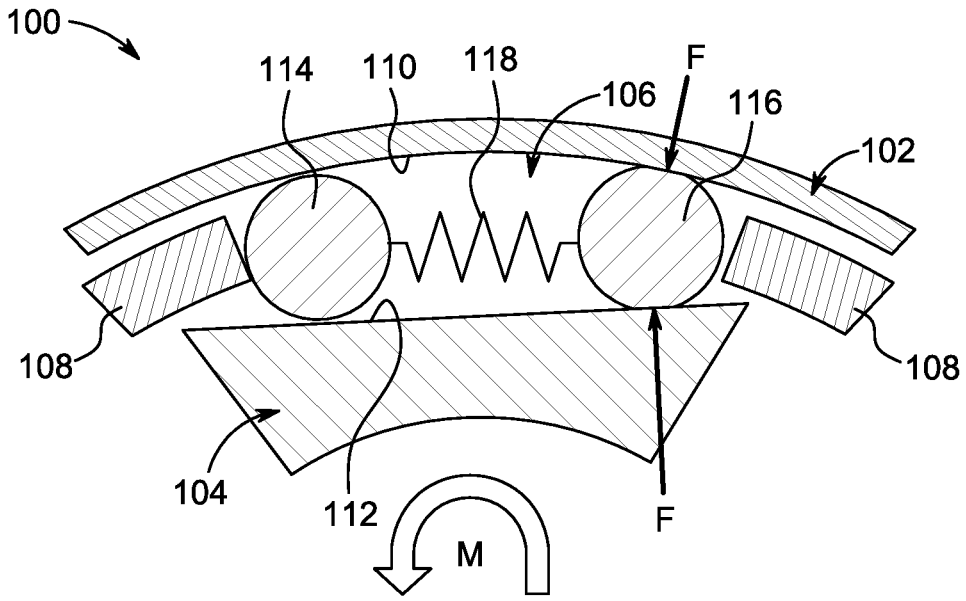
FIG. 1D is a schematic illustration of the two-way clutch of FIG. 1A with an outside force applied in a second direction and a second member of the locking mechanism in a compressed state.

During operation, once the outside force in the first direction is removed, the outside force applied to the cradle rotor 104 may transition to a second direction as illustrated in FIG. 1D. In some non-limiting examples, the outside force in the second direction may occur at a different time than the outside force in the first direction (FIG. 1B). In some non-limiting examples, the outside force applied to the cradle rotor 104 may be cyclic in magnitude and direction. In the illustrated non-limiting example, the outside force may be a torque pulse acting on the cradle rotor 104 in a counterclockwise direction. When the outside force is applied to the cradle rotor 104 in the second direction, compressive forces F may apply load to the second locking feature 116. For example, the compressive forces F may result from contact between the second locking feature 116 and both of the first mating surface 110 and the second mating surface 112. The compressive forces applied to the second locking feature 116, as a result of the outside force on the cradle rotor 104, may "lock" the second locking feature 116. That is, in this loaded state, the second locking feature 116 may prevent rotation of the cradle rotor 104 in the second direction relative to the stator 102. The first locking feature 114, however, may be supported by the cage 108 and the predetermined interference provided thereby can maintain a clearance, or gap, between the first locking feature 114 and at least one of the first mating surface 110 and the second mating surface 112. Thus, the predetermined interference can maintain the first locking feature 114 in an "unlocked" state, where it is not compressed between the first and second mating surfaces 110 and 112, and relative rotation may be achieved in the first direction between the stator 102 and the cradle rotor 104 with minimal input force.

As illustrated in FIGS. 1A-1D, the predetermined interference provided on the locking mechanism 106 by the cage 108 may maintain each of the first locking feature 114 and the second locking feature 116 "unlocked," or capable of being displaced, for example, for at least half of the outside force cycle. In addition, the predetermined interference may allow the relative rotation between the stator 102 and the cradle rotor 104 to be achieved with minimal input force.

Figure 2A:
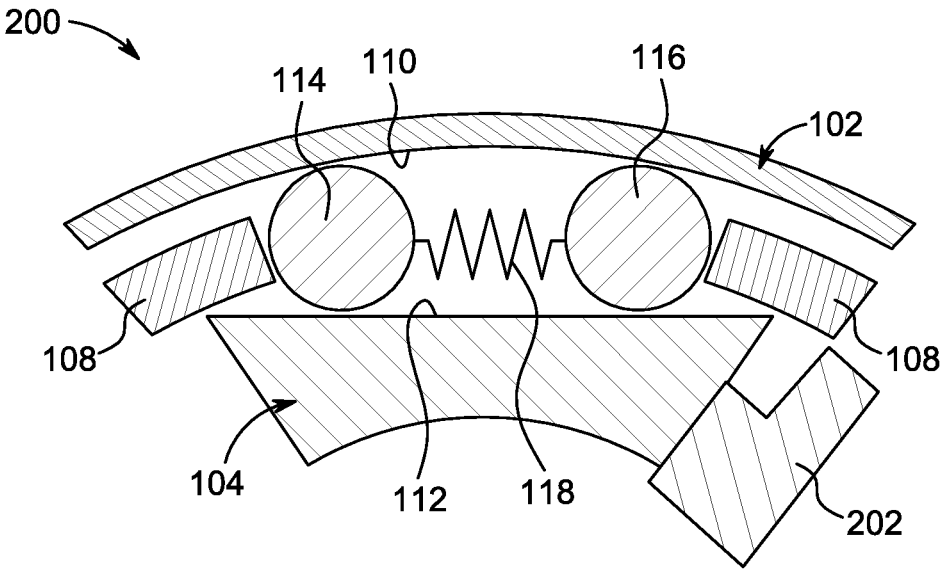
FIG. 2A is a schematic illustration of a two-way clutch including a first locking mechanism and a second locking mechanism according to one aspect of the present disclosure.
Figure 2B:
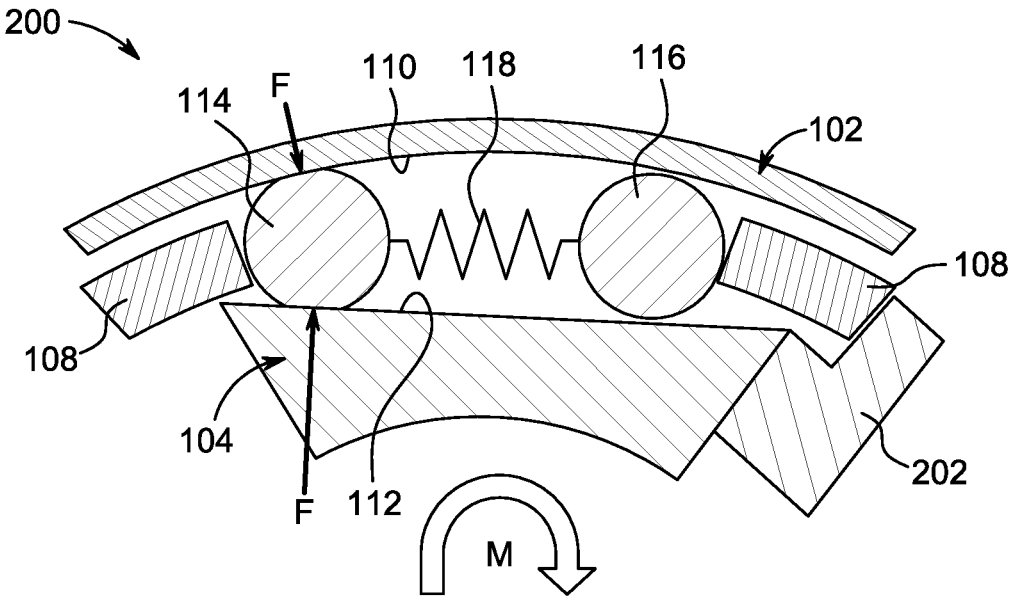
FIG. 2B is a schematic illustration of the two-way clutch of FIG. 2A with an outside force applied in a first direction and the second locking mechanism in an engaged state.
Figure 2C:
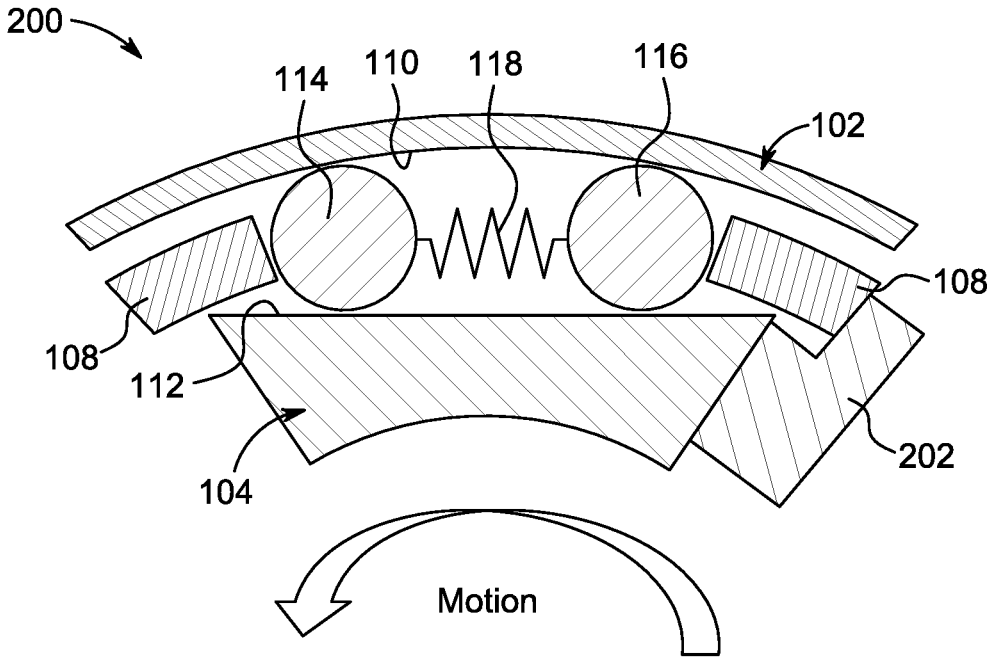
FIG. 2C is a schematic illustration of two-way clutch of FIG. 2B with the outside force removed and transitioned to a second direction.
Figure 3:
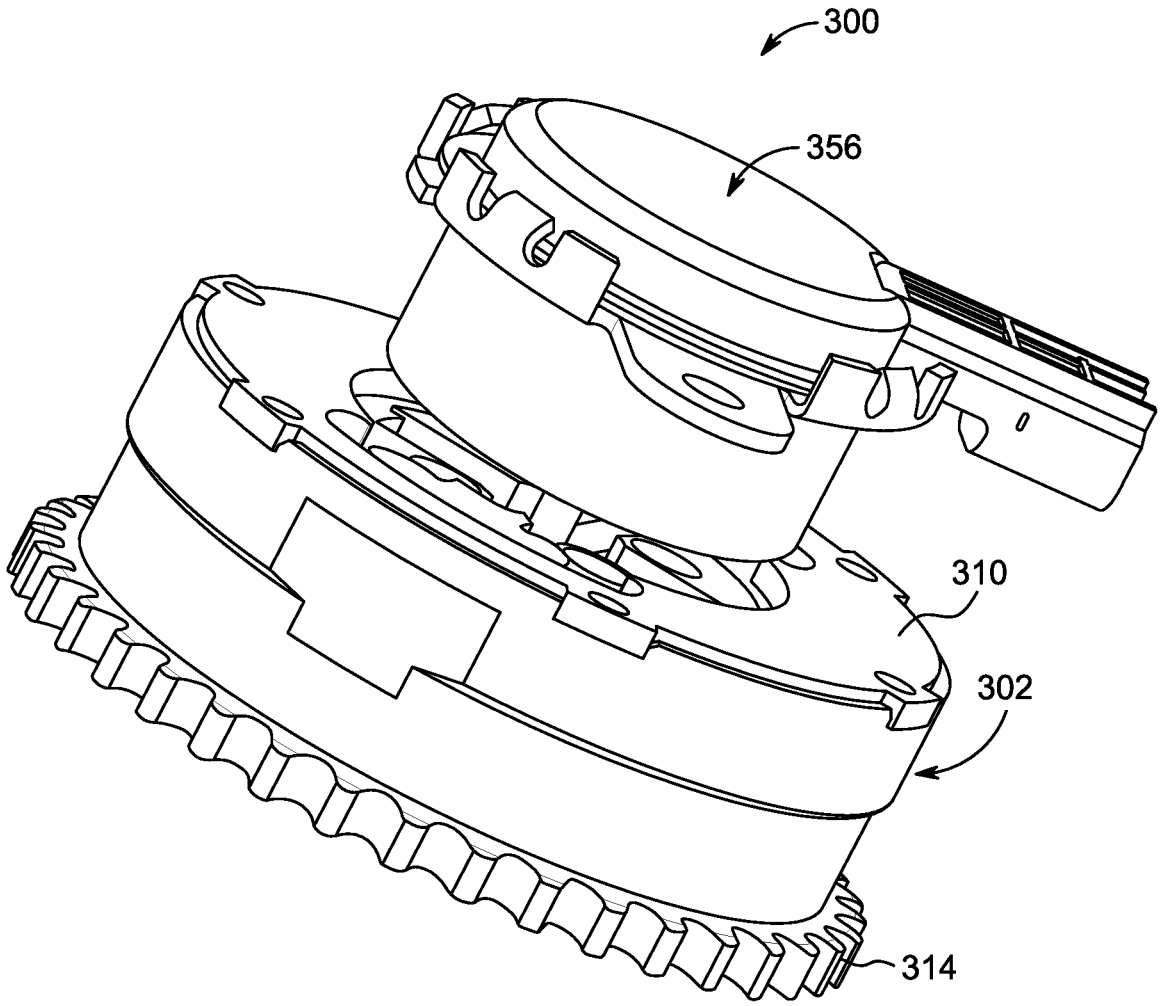
FIG. 3 is a top, front, right isometric view of a mechanical cam phasing system according to one aspect of the present disclosure.
Figure 4:
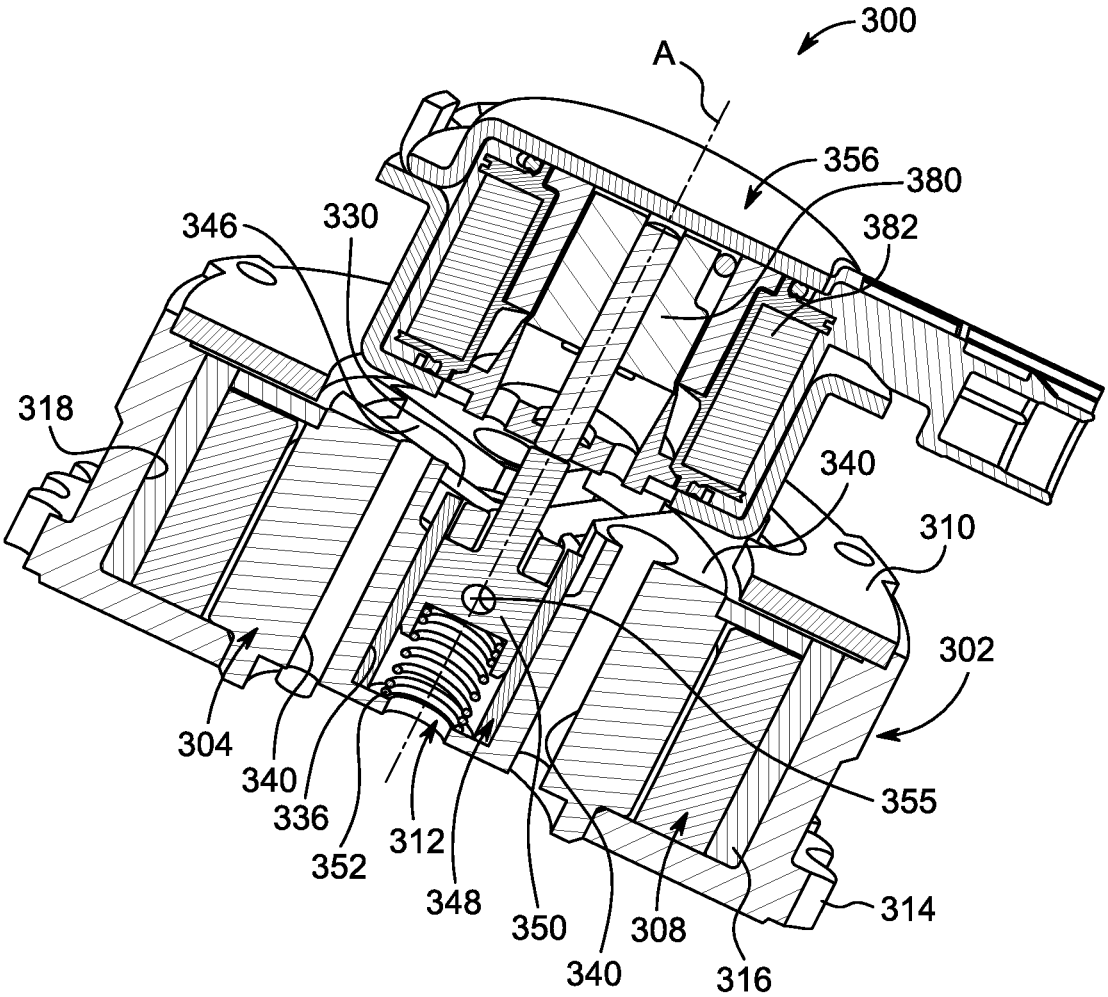
FIG. 4 is a side cross-sectional view of the mechanical cam phasing system of FIG. 3.
Figure 5:
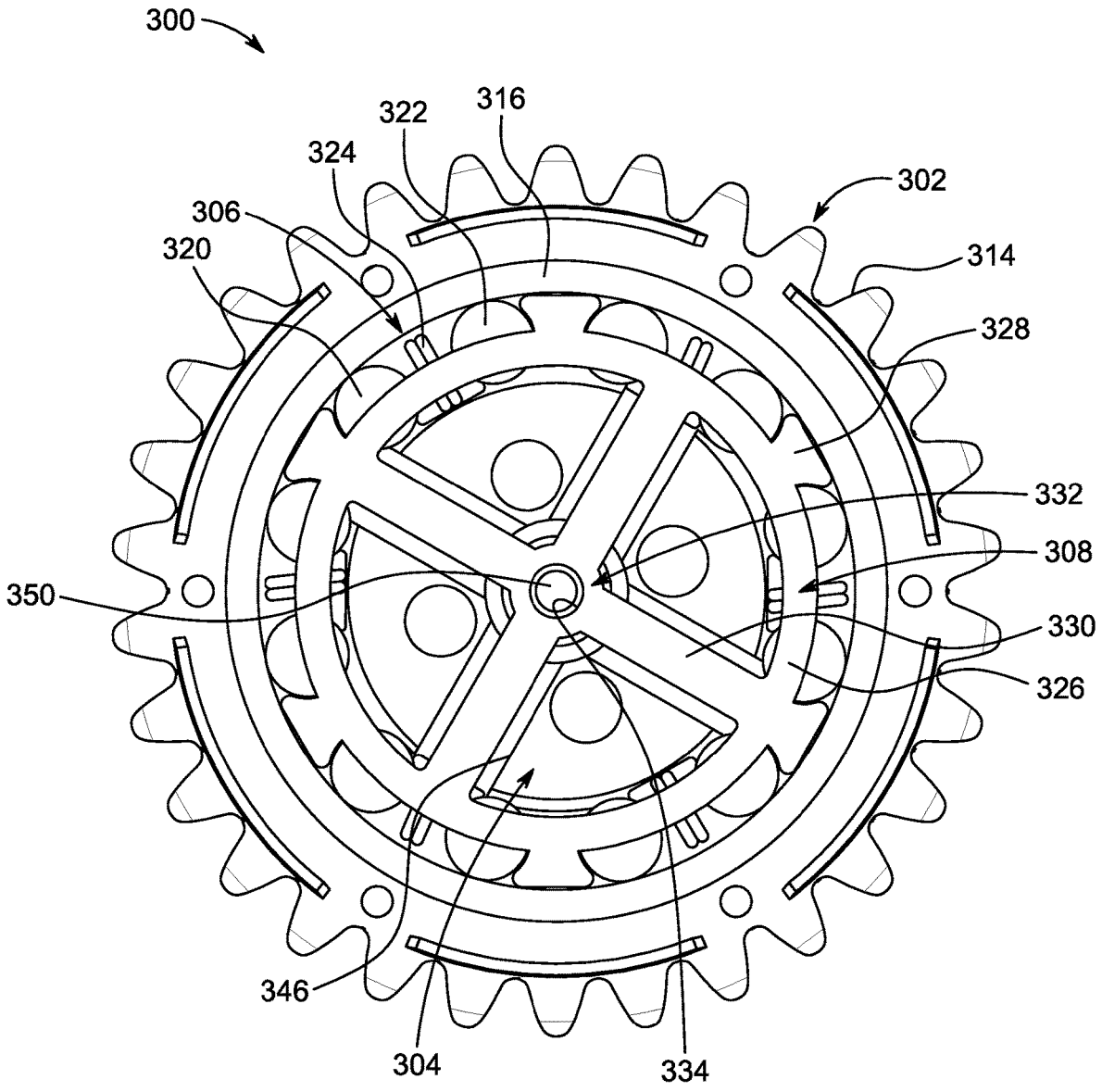
FIG. 5 is a front view of the mechanical cam phasing system of FIG. 3 with an end plate removed.
Figure 6:
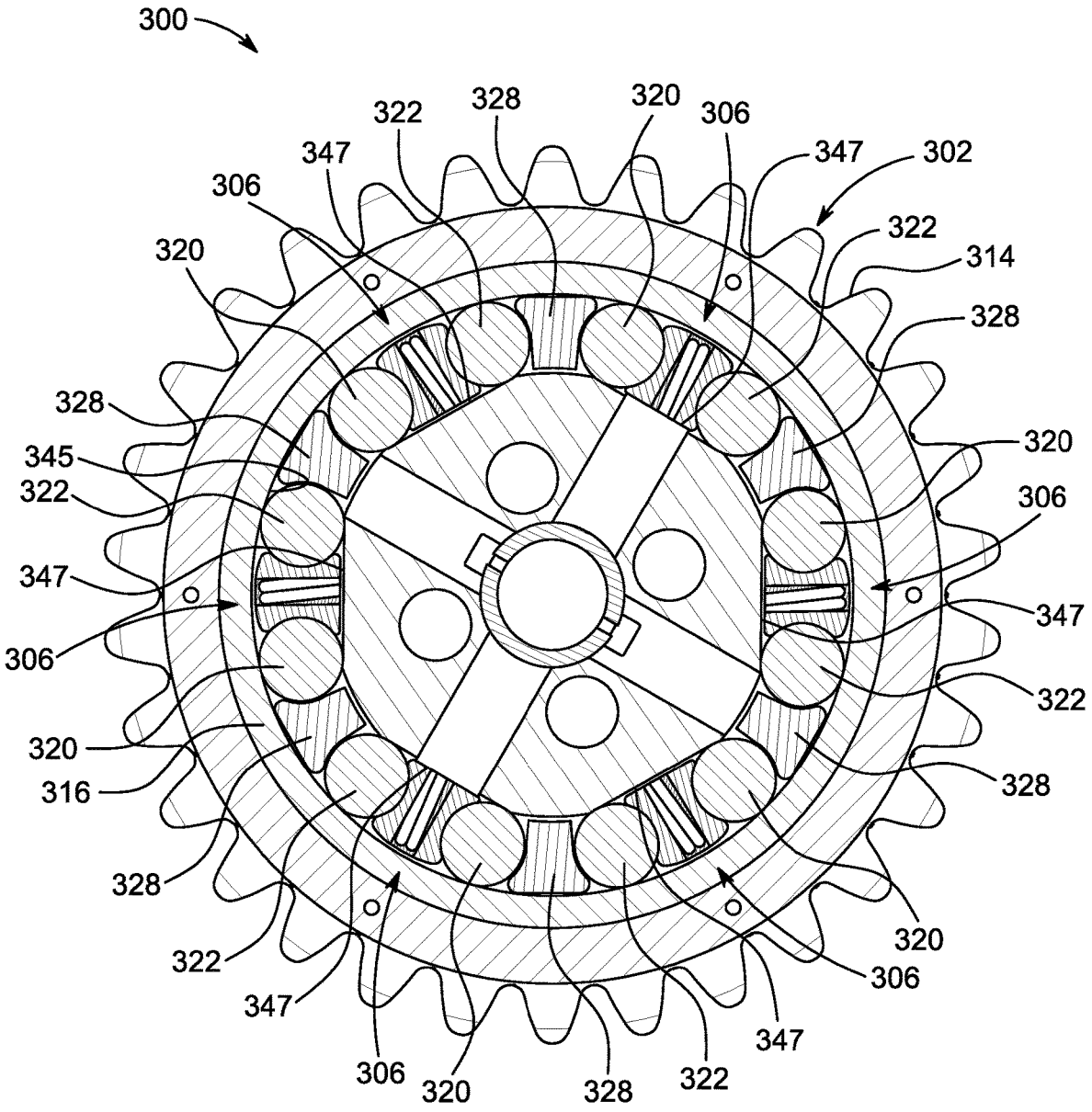
FIG. 6 is a front cross-sectional view of the mechanical cam phasing system of FIG. 3
Figure 7:
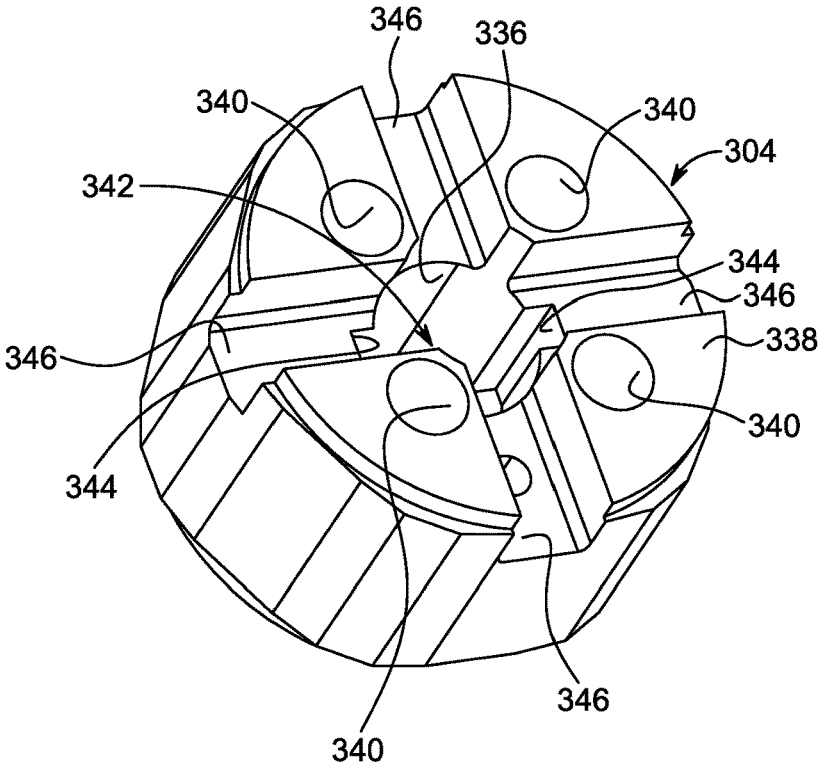
FIG. 7 is a top, front, right isometric view of a cradle rotor of the mechanical cam phasing system of FIG. 3.

FIGS. 2A-2C illustrate a two-way clutch 200 (e.g., a mechanical cam phasing system 200) according to the present disclosure. Similar to the two-way clutch 100, the two-way clutch 200 may include the stator 102, the cradle rotor 104, the locking mechanism 106, and the cage 108. However, the two-way clutch 200 may include a second locking mechanism 202 that enables the two-way clutch to leverage the interference concept described herein to selectively enable relative rotation between a stator 102 and a cradle rotor 104 in a desired direction. That is, the locking mechanism 106 may be a first locking mechanism 106, and the second locking mechanism 202 may interact with the cradle rotor 104 and the cage 108 to selectively unlock a desired one of the first locking feature 114 and the second locking feature 116 to enable relative rotation between the stator 102 and the cradle rotor 104 in a desired direction.

In general, with the predetermined interference provided on the first locking mechanism 106 by the cage 108, a predetermined amount of relative motion between the cradle rotor 104 and the cage 108 may be required for the first locking mechanism 106 to lock (i.e., prevent relative rotation between the stator 102 and the cradle rotor 104). For example, with the cage 108 holding the first locking feature 114 off of at least one of the first mating surface 110 and the second mating surface 112, the cradle rotor 104 must be allowed to move at least a predetermined amount relative to the cage 108 to ensure that the first locking feature 114 is loaded and compressed between the first mating surface 110 and the second mating surface 112. However, if this relative motion between the cradle rotor 104 and the cage 108 is prevented in a desired direction via the second locking mechanism 202, the first locking mechanism 106 may be prevented from locking in a desired direction (i.e., a selective one of the first locking feature 114 and the second locking feature 116 may remain unlocked) and thereby force the cage 108 and the cradle rotor 104 to rotate in the desired direction relative to the stator 102.

To achieve this functionality, the second locking mechanism 202 may by coupled to the cradle rotor 104 for rotation therewith. The second locking mechanism 202 may be selectively movable between a disengaged state (FIG. 2A) where the cradle rotor 104 may be allowed to move at least a predetermined amount relative to the cage 108, and an engaged state (FIGS. 2B and 2C) where the cage 108 is forced to rotate with the cradle rotor 104 in a desired direction and the relative motion therebetween may be generally prohibited.

In some non-limiting examples, the two-way clutch 200 may be applied in a rotating two-way clutch application. For example, the two-way clutch 200 may be applied in a mechanical cam phasing application, where the stator 102 may be rotatably coupled to a crankshaft on an internal combustion engine and the cradle rotor 104 may be rotatably coupled to a camshaft on an internal combustion engine.

One non-limiting example of the operation of the two-way clutch 200 in a mechanical cam phasing application will be described with reference to FIGS. 2A-2C. Generally, during operation, outside forces may be exerted on the cradle rotor 104. For example, the cradle rotor 104 may be subjected to cam torque pulses originating from the intake and exhaust valves acting on the camshaft. The cam torque pulses acting on the cradle rotor 104 may vary in direction and magnitude (e.g., cyclically) during operation of the internal combustion engine.

FIG. 2A illustrates the two-way clutch 200 in a generally locked state where the second locking mechanism 202 is in a disengaged state and at least a predetermined amount of relative motion is allowed between the cradle rotor 104 and the cage 108. In this way, for example, when an outside force is applied to the cradle rotor 104 in a first direction (e.g., clockwise) as illustrated in FIG. 2B, the cradle rotor 104 may be allowed to rotate relative to the cage 108 at least the predetermined amount. The relative rotation between the cradle rotor 104 and the cage 108 allows the first locking feature 114 to be subjected to compressive forces F resulting from contact with the first mating surface 110 and the second mating surface 112. The compressive forces applied to the first locking feature 114 as a result of the outside force on the cradle rotor 104 in the first direction may "lock" the first locking feature 114. That is, in this loaded state, the first locking feature 114 may prevent rotation of the cradle rotor 104 in the first direction relative to the stator 102.

It should be appreciated that the opposite process may occur in response to an outside force applied to the cradle rotor 104 in a second direction (e.g., counterclockwise) opposite to the first direction. That is, the second locking feature 116 may be compressed between the first mating surface 110 and the second mating surface 112 to "lock" the second locking feature 116 and prevent rotation of the cradle rotor 104 in the second direction relative to the stator 102.

At a time when the outside force in the first direction is applied to the cradle rotor 104, the second locking mechanism 202 may transition from the disengaged state to the engaged state (FIG. 2B). In this way, when the outside force in the first direction is removed and the outside force transitions to the second direction (e.g., counterclockwise), as illustrated in FIG. 2C, the second locking mechanism 202 may prevent relative rotation between the cradle rotor 104 and the cage 108 in a second direction opposite to the first direction, and maintain the cage 108 in engagement with the second locking feature 116 to hold the second locking feature 116 in an "unlocked" state. Thus, as the outside force in the second direction is applied to the cradle rotor 104, the cradle rotor 104 and the cage 108 are forced to rotate together in the second direction relative to the stator 102, thereby phasing the rotational relationship between the camshaft and the crankshaft.

It should be appreciated that the opposite process may occur for desired relative rotation between the cradle rotor 104 and the stator 102 in the first direction. That is, the second locking mechanism 202 may transition to the engaged state and force the first locking feature 114 to remain unlocked as the outside force transitions from the second direction to the first direction. As the outside force in the first direction is applied to the cradle rotor 104, the second locking mechanism 202 may prevent relative rotation between the cradle rotor 104 and the cage 108 in the first direction, and maintain the cage 108 in engagement with the first locking feature 114 to hold the first locking feature 114 in an "unlocked" state. Thus, as the outside force in the first direction is applied to the cradle rotor 104, the cradle rotor 104 and the cage 108 are forced to rotate together in the first direction relative to the stator 102, thereby phasing the rotational relationship between the camshaft and the crankshaft.

The use of the second locking mechanism 202 may be implemented in a mechanical cam phasing system to provide selective phasing between a camshaft and a crankshaft without a need for high-cost actuation systems to facilitate the phasing. For example, a single, low-force actuator may be used to facilitate the selective phasing between the camshaft and the crankshaft, which simplifies the actuation and substantially reduces a cost of the cam phasing system when compared to conventional mechanical, hydraulic, and electronic cam phasing systems. In addition, this simplified actuation may enable the mechanical cam phasing system to be operable with a reduced number of components when compared to conventional cam phasing systems.

FIGS. 3-6 illustrate one non-limiting example of a mechanical cam phasing system 300 that leverages the advantages of the second locking mechanism 202 and the predetermined interference concept described herein. In the illustrated non-limiting example, the mechanical cam phasing system 300 may include a stator 302, a cradle rotor 304, a plurality of first locking assemblies 306, a cage 308, an end cap 310, and a second locking assembly, or an actuation assembly, 312. The stator 302 may include a gear 314 and a stator ring 316. The gear 314 may be arranged circumferentially around an outer periphery of the stator 302 to facilitate the rotational coupling of the stator to a crankshaft on an internal combustion engine (e.g., via a gear train or belt). The stator ring 316 may be designed to be inserted into the stator 302, such that the stator ring 316 arranged radially inward from and in engagement with an inner surface 318 of the stator 302. In some non-limiting examples, a simplified geometry defined by the stator ring 316 may enable the stator ring 316 to be fabricated from a hardened material when compared to the stator 302 to reduce wear from interaction with the first locking assemblies 306.

In general, the stator 302, the cradle rotor 304, the cage 308, and the actuation assembly 312 may be arranged concentrically about a common axis A. For the description herein of features relating to or included within the mechanical cam phasing system 300, the use of the terms "axial," "radial," and "circumferential" (and variations thereof) are based on a reference axis corresponding to the axis A.

In the illustrated non-limiting example, the cradle rotor 304 may be arranged at least partially within the stator 302 and may be rotationally coupled to a camshaft on an internal combustion engine for rotation therewith. In the illustrated non-limiting example, each of the first locking assemblies 306 may include a first locking feature 320, a second locking feature 322, and a biasing element 324. The biasing element 324 may be arranged between and in engagement with corresponding pairs of the first and second locking features 320 and 322, thereby biasing the first and second locking features 322 and 324 away from one another. In some non-limiting examples, the biasing elements 324 may be in the form of a spring. In some non-limiting examples, the biasing elements 324 may be in the form of any viable mechanical linkage capable of forcing the first locking feature 320 and the second locking feature 322 away from one another, as desired. In some non-limiting examples, each of the first locking assemblies 306 may include one or more biasing elements 324. In some non-limiting examples, the first locking feature 320 and the second locking feature 322 may be in the form of roller bearings. In some non-limiting examples, the first locking feature 320 and the second locking feature 322 may be in the form of a wedge.

In the illustrated non-limiting example, the cage 308 may include a cage ring 326, a plurality of cage protrusions 328, a plurality of cage arms 330, and a central cage hub 332. The cage ring 326 may be arranged radially between the cradle rotor 304 and the stator 302 (i.e., between the cradle rotor 304 and the radially inner surface of the stator ring 316). A plurality of cage protrusions 328 may extend axially away from the cage ring 326 and toward the first locking assemblies 306 for engagement therewith. In the illustrated non-limiting example, the cage protrusions 328 are arranged circumferentially around the cage ring 326. In the illustrated non-limiting example, each circumferentially adjacent pair of the cage protrusions 328 includes a corresponding one of the plurality of first locking assemblies 306 arranged therebetween. That is, one of the cage protrusions 328 may engage the first locking feature 320 of a corresponding one of the first locking assemblies 306, and a circumferentially adjacent cage protrusion 328 may engage the second locking feature 322 of the corresponding one of the first locking assemblies 306. The engagement by the cage protrusions 328 on the first locking features 320 and the second locking features 322 may provide a predetermined interference thereto that displaces the first locking feature 320 and the second locking feature 322 out of engagement with at least one of the stator 302 and the cradle rotor 304, when the cradle rotor 304 is in an unloaded state (i.e., no outside forces applied to the cradle rotor 304). As will be described herein, the actuation assembly 312 may be configured to selectively maintain the predetermined interference on either the first locking feature 320 or the second locking feature 322 by selectively rotationally coupling the cradle rotor 304 and the cage 308, which, in turn, allows relative rotation between stator 302 and the cradle rotor 304 in a desired direction with minimal input force.

In the illustrated non-limiting example, each of the cage arms 330 extend radially between the central cage hub 332 and the radially inner surface of the cage ring 326, and arranged circumferentially about the cage 308. In some non-limiting examples, the cage 308 includes four cage arms 330. In some non-limiting examples, the cage 308 includes more or less than four cage arms 330. The central cage hub 332 includes a cage aperture 334 extending axially therethrough.

With reference to FIGS. 4-7, in the illustrated non-limiting example, the cradle rotor 304 may include an inner surface 336, an upper surface 338, and a plurality of cam-coupling apertures 340. The inner surface 336 of the cradle rotor 304 defines an inner bore 342 that extends axially at least partially through the cradle rotor 304. In the illustrated non-limiting example, the inner surface 336 includes a pair of opposed pin slots 344 that are radially recessed into the inner surface 336 and extend axially therealong. In some non-limiting examples, the inner surface 336 may include at least one pin slot 344. In the illustrated non-limiting example, the upper surface 338 includes a plurality of cage slots 346 that are axially recessed into the upper surface 338 and extend radially therealong. The cage slots 346 may extend radially from the inner surface 336 to an outer periphery of the upper surface 338. In some non-limiting examples, the upper surface 338 may include at least one cage slot 346.

Each of the cage slots 346 may receive a corresponding one of the cage arms 330 therein. The cage slots 346 and the cage arms 330 may be designed to ensure that when the cage arms 330 is received within the cage slots 346, the cage arms 330 are provided with sufficient lateral, or circumferential, clearance to not engage any portion of the cage slots 346 during operation.

In the illustrated non-limiting example, each of the first locking assemblies 306 is arranged between a first mating surface 345 arranged on the stator 302 and a second mating surface 347 arranged on the cradle rotor 304. In the illustrated non-limiting example, the first mating surface 345 may be the radially inward surface of the stator ring 316, and the second mating surface 347 may be defined by the outer periphery of the cradle rotor 304.

In the illustrated non-limiting example of FIGS. 3-9, the actuation assembly 312 may include a slot tube 348, a plunger 350, a spring 352, a pin 354, and a solenoid 356. The slot tube 348 may be received within the inner bore 342 of the cradle rotor 304, and the plunger 350 and the spring 352 may be received within the slot tube 348. The spring 352 may be biased against the cradle rotor 304 to provide a force on the plunger 350 in a direction toward the solenoid 356. The plunger 350 may include a pin aperture 355 extending radially therethrough and may be axially slidable within the slot tube 348 in response to an input displacement from the solenoid 356.

In the illustrated non-limiting example, the slot tube 348 may include a plurality of tabs 358 and a pair of opposing slots 362. In some non-limiting examples, the slot tube 348 may include more than two slots 362. The plurality of tabs 358 extend axially from an upper surface of the slot tube 348, and form tube slots 360 in between circumferentially adjacent tabs 358 that align with the cage slots 346 in the cradle rotor 304. Each of the tube slots 360 is configured to receive a corresponding one of the cage arms 330 to rotationally key, or couple, the slot tube 348 to the cage 308.

Each of the slots 362 extends radially through and axially along a portion of the slot tube 348. In general, the slots 362 may each define a locking state and one or more phasing states for operation of the cam phasing system 300. For example, the locking state may correspond with a locking region defined along the slots 362, which inhibits relative rotation between the cradle rotor 304 and the stator 302. The one or more phasing states may correspond with one or more phasing regions defined along the slots 362 to enable or allow relative rotation between the cradle rotor 304 and the stator 302. In some non-limiting examples, the slots 362 may define three regions or axial locations where the pin 354 may be displaced to by the solenoid 356 to facilitate different the different operating modes, or states, of the cam phasing system 300. For example, the slots 362 may include a locking region, a forward phasing region (advance), and a backward phasing region (retard). Switching between the locking region and either the forward phasing region or the backward phasing region may adjust a clearance between the cradle rotor 304 and the cage 308. That is, a clearance between the pin 354 and the slots 362 formed in the slot tube 348 may be adjusted by switching, or displacing the pin 354, between the locking region and either the forward phasing region or the backward phasing region. In some non-limiting examples, displacing the pin 354 to the forward phasing region or the backward phasing region may reduce a clearance between the pin 354 and the slots 362 to ensure that the pin 354 engages the slots 362 and allow the cage 308 to displace either the first locking features 320 or the second locking features 322 (depending on whether forward or backward phasing is desired) relative to the stator 304, which enables the cradle rotor 304 to harvest outside forces in a desired direction and rotate relative to the stator 302.

For example, when the pin 354 is in the locking region, the slots 362 may define enough rotational clearance relative to the pin 354 to enable the cradle rotor 304 to rotate relative to the cage 308 an amount sufficient to compress and lock the first locking feature 320 or the second locking feature 322 (depending on the direction of an outside force applied to the cradle rotor 304) and provide bi-directional locking between the cradle rotor 304 and the stator 302. When the pin 354 is displaced to the forward phasing region, the slots 362 may define a geometry that provides sufficient clearance relative to the pin 354 in a first direction to prevent relative rotation between the cradle rotor 304 and the stator 302 in the first direction and that ensures engagement between the pin 354 and the slots 362, when an outside force is applied to the cradle rotor 304 in a second direction. The engagement between the pin 354 and the slots 362 may unlock, for example, the first locking feature 320 and the outside force applied to the cradle rotor 304 in the second direction may be allowed to rotate the cradle rotor 304 relative to the stator 302. When the pin 354 is displaced to the backward phasing region, the slots 362 may define a geometry that provides sufficient clearance relative to the pin 354 in a second direction to prevent relative rotation between the cradle rotor 304 and the stator 302 in the second direction and that ensures engagement between the pin 354 and the slots 362, an outside force is applied to the cradle rotor 304 in the first direction. The engagement between the pin 354 and the slots 362 may unlock, for example, the second locking feature 322 and the outside force in the first direction applied to the cradle rotor 304 may be allowed to rotate the cradle rotor 304 relative to the stator 302.

Figure 8:
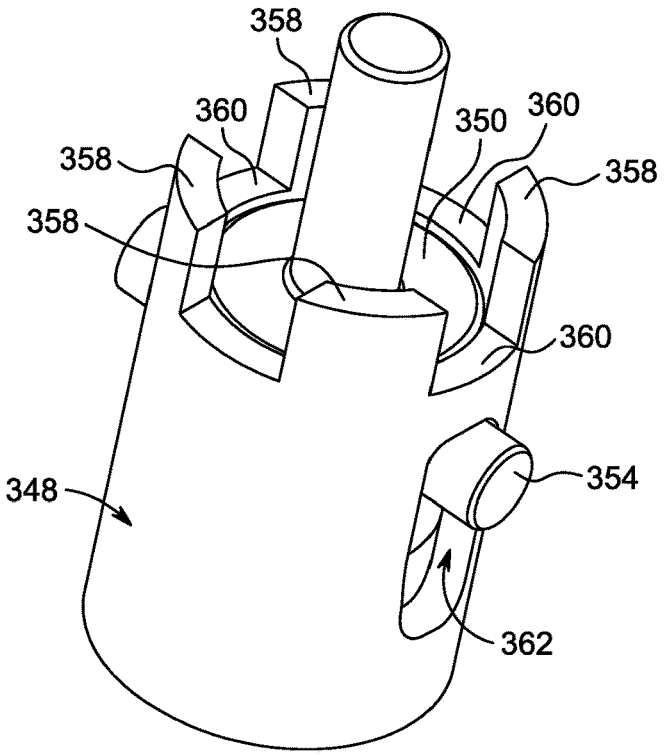
FIG. 8 is a top, front, right isometric view of a slot tube, a plunger, and a pin of the mechanical cam phasing system of FIG. 3.
Figure 9:
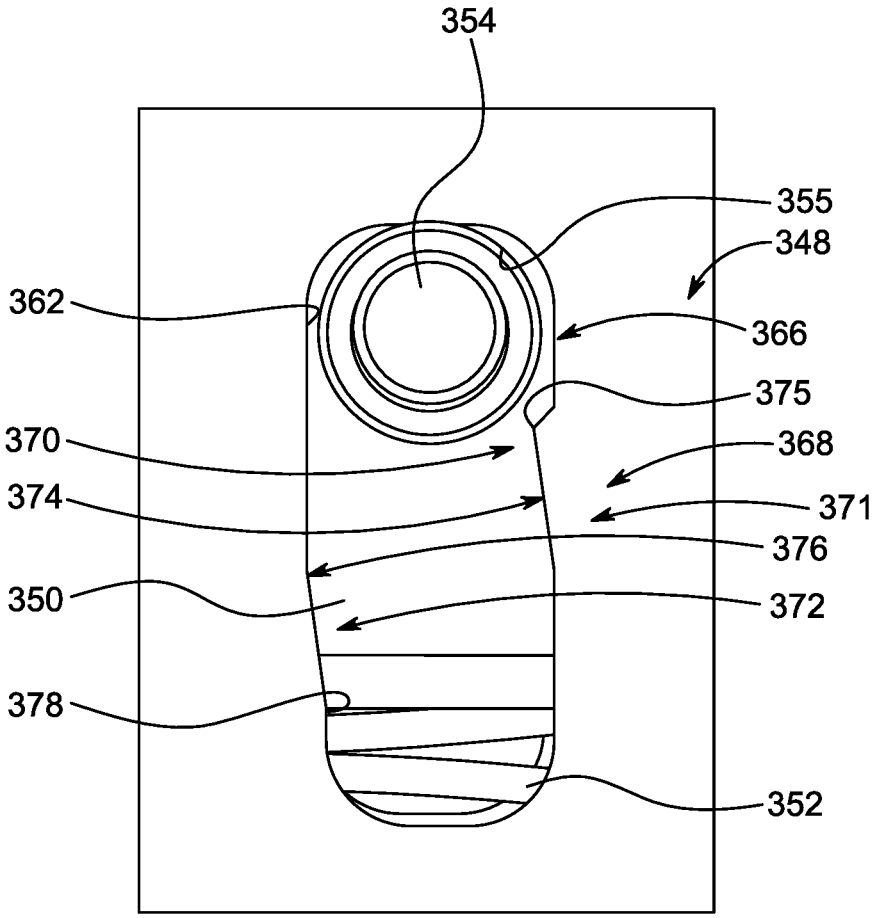
FIG. 9 is a side view of the slot tube, the plunger, and the pin of FIG. 8.

With specific reference to FIGS. 8 and 9, each of the slots 362 defines a clearance portion 366 and a ramped portion 368. In the illustrated non-limiting example, the ramped portion 368 may include a first ramped portion 370, a ramped clearance portion 371, and a second ramped portion 372, with the first ramped portion 370 arranged axially between the clearance portion 366 and the second ramped portion 372.

In the illustrated non-limiting example, the clearance portion 366 and ramped clearance portion 371 of the slot 362 may define the greatest lateral width along the slot 362, when compared to the first ramped portion 370 and the second ramped portion 372. The clearance portion 366 and the ramped clearance portion 371 may define locking regions for the pin 354 along the slot 362. The first ramped portion 370 extends laterally inward from a first side 374 of the slot 362, and defines a ramp that decreases in laterally-inward protrusion as the ramp extends axially away from a first peak 375 arranged at a location axially adjacent to the clearance portion 366. The second ramped portion 372 extends laterally inward from a second side 376 of the slot 362, and defines a ramp that decreases in laterally-inward protrusion as the ramp extends axially away from a second peak 378 arranged at a location axially away from the clearance portion 366 (i.e., the clearance portion 366 may be arranged at one end of the slot 362 and the second peak 378 may be arranged adjacent to an axially opposing end of the slot 362). The first ramped portion 370 and the second ramped portion 372 may define the forward phasing region and the backward phasing region for the pin 354 along the slot 362. The ramped clearance portion 371 may be arranged axially between the first ramped portion 370 and second ramped portion 372. In the illustrated non-limiting example, the first ramped portion 370 and the second ramped portion 372 taper axially toward one another. In some non-limiting examples, the orientation and arrangement of the clearance portion 366 and the ramped portion 368 may vary. In general, the use of the slots 362, in combination with the use of a spring, enable a single, unidirectional solenoid to actuate the mechanical cam phasing system 300.

Figure 10:
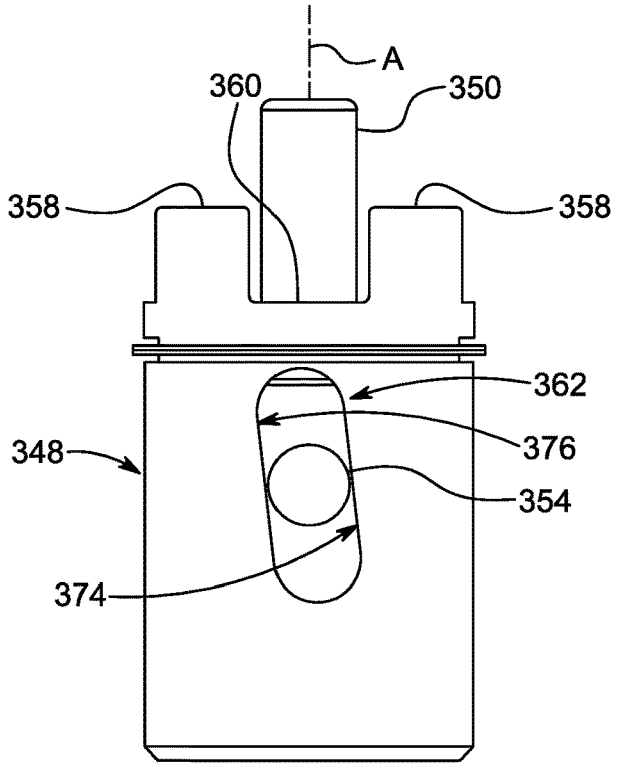
FIG. 10 is a side view of a slot tube, a plunger, and a pin of the cam phasing system of FIG. 3 according to another aspect of the present disclosure.
Figure 11:
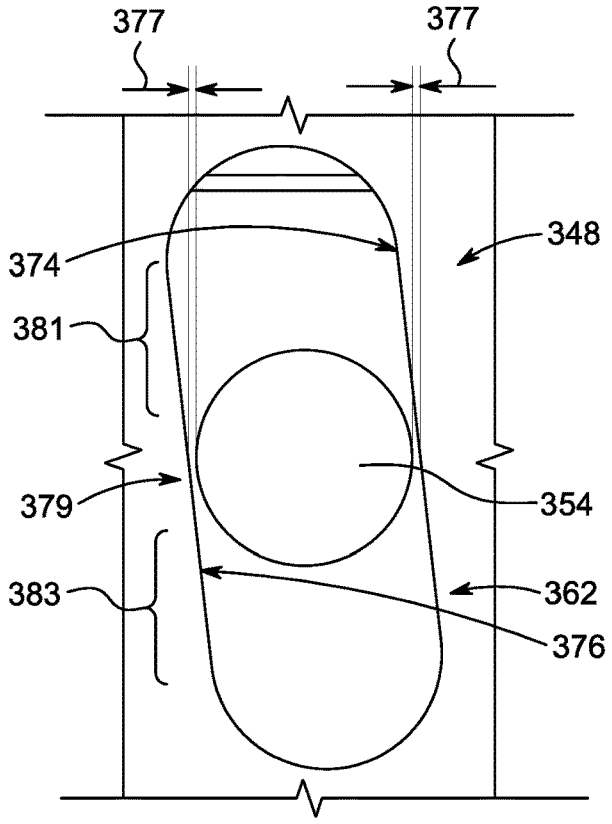
FIG. 11 is an enlarged view of a portion of the slot tube and the pin of FIG. 10.

In some non-limiting examples, the slots 362 may define an alternative geometry that enables the three regions of operation for the cam phasing system 300. For example, FIGS. 10 and 11 illustrate another non-limiting example of the slot tube 348 where the slots 362 define a generally angled, or helical, shape. That is, the first side 374 and the second side 376 of the slots 362 may be angled relative to the axis A along which the pin 354 is displaced. The slots 362 may define a locking region 379, or neutral position, for the pin 354 (FIG. 11) that is arranged axially between the forward phasing region 381 and the backward phasing region 383 along the slots 362. In the illustrated non-limiting example, the neutral position 379 may be generally centered axially along the slots 362. During operation, if the pin 354 is axially displaced from the neutral position 379 in a first axial direction (e.g., upwardly from the perspective of FIG. 11), the pin 354 may be displaced into the forward phasing region 381 defined along the slots 362. If the pin 354 is axially displaced from the neutral position in a second axial direction (e.g., downwardly from the perspective of FIG. 11), the pin 354 may be displaced into the backward phasing region 383 defined along the slots 362.

In the neutral position 379 illustrated in FIG. 11, a clearance 377 is defined between the slot 362 and both sides of the pin 354. The clearance 377 may be dimensioned to enable the cradle rotor 304 to displace (e.g., rotationally) relative to the cage 308, when outside forces (e.g., cyclical cam torque pulses) are applied to the cradle rotor 304, to allow the first locking feature 320 or the second locking feature 322 (depending on the direction of the outside force) to lock via compression between the first mating surface 345 of the stator 302 and the second mating surface 347 of the cradle rotor 304. As the pin 354 is displaced axially away from the neutral position 379 to, for example, the forward phasing region 381, the pin 354 may be displaced into closer proximity to, or into engagement with, the first side 374 of the slot 362 due to the angled, or helical, arrangement of the slot 362 relative to the axis A. In this way, for example, the geometry of the slot 362 may ensure that the pin 354 engages the first side 374 of the slot 362 when the cradle rotor 304 is subjected to outside forces in a first direction (e.g., clockwise). While the angled arrangement of the slot 362 may bring the pin 354 into closer proximity to, or into engagement with, the first side 374 of the slot 362 in the forward phasing region 381, the pin 354 may maintain at least the clearance 377 defined at the neutral position 379 between the pin 354 and the second side 376. This may enable the cradle rotor 304 to displace relative to the stator 302, without the pin 354 engaging the second side 376 of the slot 362, to allow, for example, the second locking features 322 to lock via compression between the first mating surface 345 of the stator 302 and the second mating surface 347 of the cradle rotor 304.

Alternatively, as the pin 354 is displaced axially away from the neutral position 379 to, for example, the backward phasing region 383, the pin 354 may be displaced into closer proximity to, or into engagement with, the second side 376 of the slot 362 due to the angled, or helical, arrangement of the slot 362 relative to the axis A. In this way, for example, the geometry of the slot 362 may ensure that the pin 354 engages the second side 376 of the slot 362 when the cradle rotor 304 is subjected to outside forces in a second direction (e.g., counterclockwise). While the angled arrangement of the slot 362 may bring the pin 354 into closer proximity to, or into engagement with, the second side 376 of the slot 362 in the backward phasing region 383, the pin 354 may maintain at least the clearance 377 defined at the neutral position 379 between the pin 354 and the first side 374. This may enable the cradle rotor 304 to displace relative to the stator 302, without the pin 354 engaging the first side 374 of the slot 362, to allow, for example, the first locking feature 320 to lock via compression between the first mating surface 345 of the stator 302 and the second mating surface 347 of the cradle rotor 304.

In any configuration, when assembled, the pin 354 may extend laterally through the pin aperture 355 in the plunger 350, the slots 362 of the slot tube 348, and at least partially into the pin slots 344 of the cradle rotor. For example, opposing ends of the pin 354 may extend into the pin slots 344 to rotationally couple the plunger 350 and the pin 354 to the cradle rotor 304 for rotation therewith.

In the illustrated non-limiting example, the solenoid 356 may be arranged externally from the stator 302. In some non-limiting examples, the solenoid 356 may be arranged within the stator 302 as will be described herein. The solenoid 356 may include an armature 380 that is selectively displaceable to a desired position in response to a current applied to a wire coil 382. The armature 380 may be coupled to the plunger 350 to selectively displace the plunger 350 axially along the slot tube 348 against the force of the spring 352, which displaces the pin 354 axially along the slots 362 to a desired position (see, e.g., FIG. 4).

General operation of the cam phasing system 300 will be described with reference to FIGS. 3-9. In operation, the actuation assembly 312 may be configured to selectively transition a rotational relationship between the stator 302 and the cradle rotor 304 from a locked state where relative rotation therebetween is inhibited and an unlocked state where relative rotation is enabled in a desired direction. For example, when no relative rotation between the stator 302 and the cradle rotor 304 is desired, the solenoid 356 may be de-energized and the spring 352 may force the pin 354 into the clearance portion 366 of the slots 362. The increased lateral width of the clearance portion 366 may allow the cradle rotor 304 to move relative to the cage 308 a predetermined amount sufficient to enable either the first locking feature 320 or the second locking feature 322 to lock via compression between the first mating surface 345 of the stator 302 and the second mating surface 347 of the cradle rotor 304, depending on the direction of cam torque pulse applied to the cradle rotor 304. For example, if a cam torque pulse is applied to the cradle rotor 304 in a first direction (e.g., clockwise), the cradle rotor 304 will be allowed to move relative to the cage 308 an amount that is governed by the clearance between the pin 354 and the second side 376 of the slot 362. This clearance between the pin 354 and the second side 376 of the slot 362 is designed to be sufficient to allow the cradle rotor 304 to move relative to the cage 308 enough to lock the first locking feature 320 via compression between the first mating surface 345 of the stator 302 and the second mating surface 347 of the cradle rotor 304, without allowing the pin 354 to engage the second side 376 of the slot 362.

When it is desired to allow the cradle rotor 304 to rotate relative to the stator 302 in a second direction (e.g., counterclockwise), the solenoid 356 may displace the pin 354 to be axially aligned with the first ramped portion 370. The reduced clearance between the pin 354 and the first ramped portion 370 may ensure that the pin 354 engages the first side 374 of the slot 362 in response to a cam torque pulse applied to the cradle rotor 304 in a second direction (e.g., counterclockwise) via the rotational coupling between the pin 354 and the cradle rotor 304. Once the pin 354 engages the first side 374 of the slot 362, relative motion between the cradle rotor 304 and the cage 308 is prevented in the second direction via the rotational coupling of the cage 308 and the slot tube 348. In addition, the cage 308 is maintained in engagement with the second locking feature 322 and applies the predetermined interference thereto, which keeps the second locking feature 322 unlocked. In this way, when the cam torque pulse rotates the cradle rotor 304 in the second direction, the cage 308 and cradle rotor 304 are allowed to rotate together relative to the stator 302.

Conversely, when it is desired to allow the cradle rotor to rotate relative to the stator 302 in a first direction (e.g., clockwise), the solenoid may displace the pin 354 to by axially aligned with the second ramped portion 372. The reduced clearance between the pin 354 and the second ramped portion 372 may ensure that the pin 354 engages the second side 376 of the slot 362 in response to a cam torque pulse applied to the cradle rotor 304 in a first direction (e.g., clockwise). Once the pin 354 engages the second side 376 of the slot 362, relative motion between the cradle rotor 304 and the cage 308 is prevented in the first direction via the rotational coupling of the cage 308 and the slot tube 348. In addition, the cage 308 is maintained in engagement with the first locking feature 320 and applies the predetermined interference thereto, which keeps the first locking feature unlocked. In this way, when the cam torque pulse rotates the cradle rotor 304 in the first direction, the cage 308 and the cradle rotor 304 are allowed to rotate relative to the stator 302.

During operation, when it is desired to transition from an unlocked state to a locked state, the pin 354 may be displaced by the solenoid 356 from one of the first ramped portion 370 and the second ramped portion 372 to axially align with the ramped clearance portion 371. Similar to the clearance portion 366, the ramped clearance portion 371 may allow the cradle rotor 304 to move relative to the cage 308 a predetermined amount sufficient to enable either the first locking feature 320 or the second locking feature 322 to lock via compression between the first mating surface 345 of the stator 302 and the second mating surface 347 of the cradle rotor 304, depending on the direction of cam torque pulse applied to the cradle rotor 304. In some non-limiting examples, the clearance portion 366 may be a "default" locked position for the pin 354 that ensures the system is locked, when the solenoid is de-energized (e.g., after engine shutdown).

With the ramped clearance portion 371 being axially between the first ramped portion 370 and the second ramped portion 372, the ramped clearance portion 371 may be a closer option for locking the system during operation, when compared to the clearance portion 366. Thus, during operation, the ramped clearance portion 371 may be used to facilitate the locking of the system, and the pin 354 may be selectively displaced to axially align with a portion of the first ramped portion 370 or the second ramped portion 372 to enable unlocking in a desired direction (i.e., relative rotation between the cradle rotor 304 and the stator 302 in a desired direction.

In the illustrated non-limiting example, the ramped profiled defined by the first ramped portion 370 and the second ramped portion 372 may enable a proportional control of the locking and unlocking between the cradle rotor 304 and the stator 302. For example, when the pin 354 is aligned axially closer to either the first peak 375 or the second peak 378, the relative rotation between the cradle rotor 304 and the stator 302 may be fully unlocked in a desired direction. If the pin 354 is aligned axially with a region of the first ramped portion 370 or the second ramped portion 372 away from the peaks 375, 378, the incrementally increased clearance between the pin 354 and the respective one of the first side 374 and the second side 376 may enable a partially unlocked state. That is, the cradle rotor 304 may be allowed to rotate relative to the stator 302 a predetermined amount prior to the cradle rotor 304 fully engaging and locking one of the first locking feature 320 and the second locking feature 322 (depending of the direction of the cam torque pulse). In this partially unlocked state, the relative motion between the cradle rotor 304 and the stator 302 may be slowed down, when compared to the fully unlocked state, which is beneficial when trying to control the mechanical cam phasing system 300 during smaller, fine phasing adjustments.

Figure 12:
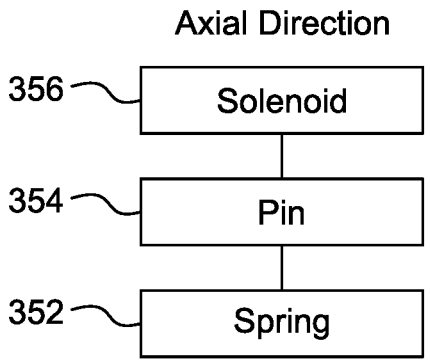
FIG. 12 is a schematic illustration of axially-moving components in the cam phasing system of FIG. 3.
Figure 13:
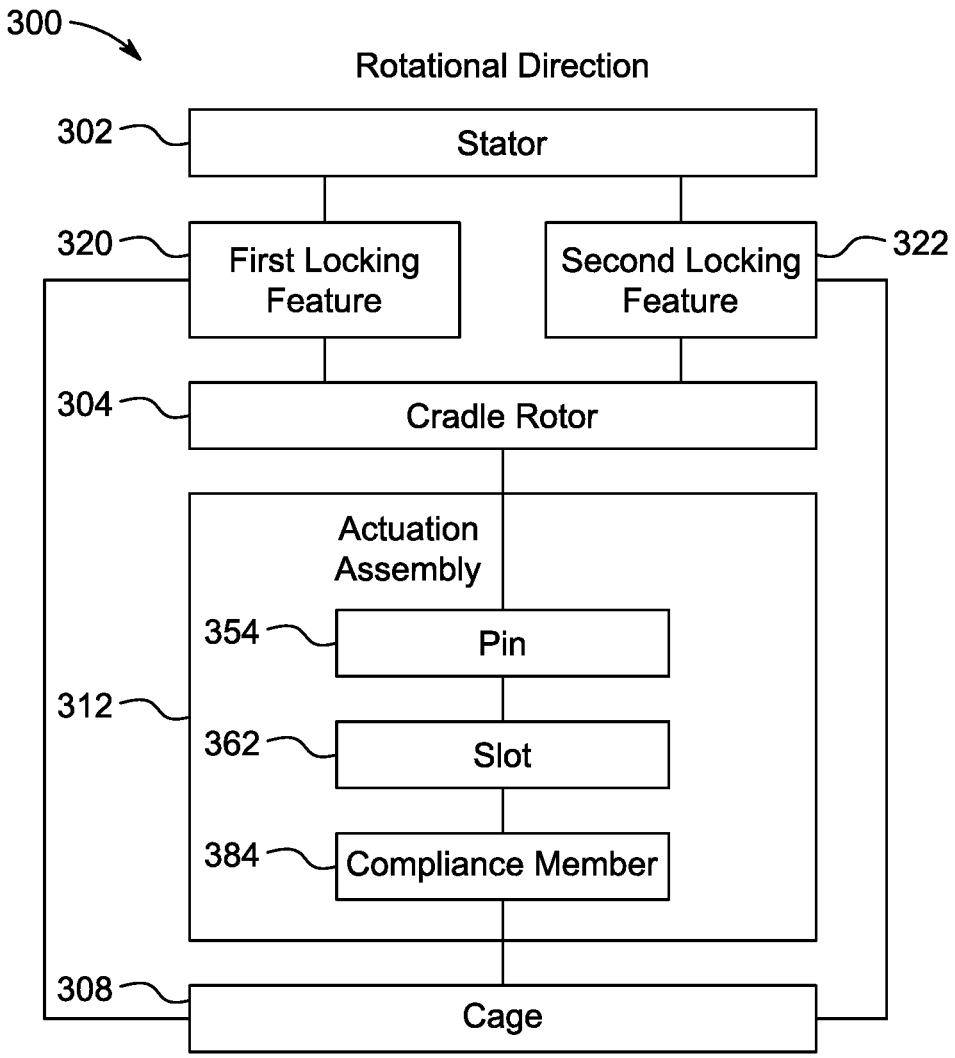
FIG. 13 is a schematic illustration of rotationally-moving components in the cam phasing system of FIG. 3 with a compliance mechanism.

In some non-limiting examples, the cam phasing system 300 may include a compliance member rotationally coupled between the cage 308 and the slot tube 348 (and the slots 362) that enables proportion control of the relative rotation speed between the cradle rotor 304 and the stator 302, by controlling the amount of relative rotation that occurs between these parts when outside forces are applied to the cradle rotor 304. For example, as illustrated in FIGS. 12 and 13, the cam phasing system 300 may include a compliance member 384 arranged between the slots 362 and the cage 308. In some non-limiting examples, the compliance member 384 may be configured to provide a predetermined amount of rotational lash or rotational relative motion between the cage 308, which is rotationally coupled to the slots 362 thought the compliance member 384, and the cradle rotor 304, which is rigidly coupled to the pin 354 for rotation therewith. In some non-limiting examples, the compliance member 384 may be in the form of a bendable arm that is coupled between the cage 308 and the slot tube 348. In some non-limiting examples, the compliance member 384 may be in the form of a spring.

Figure 14:
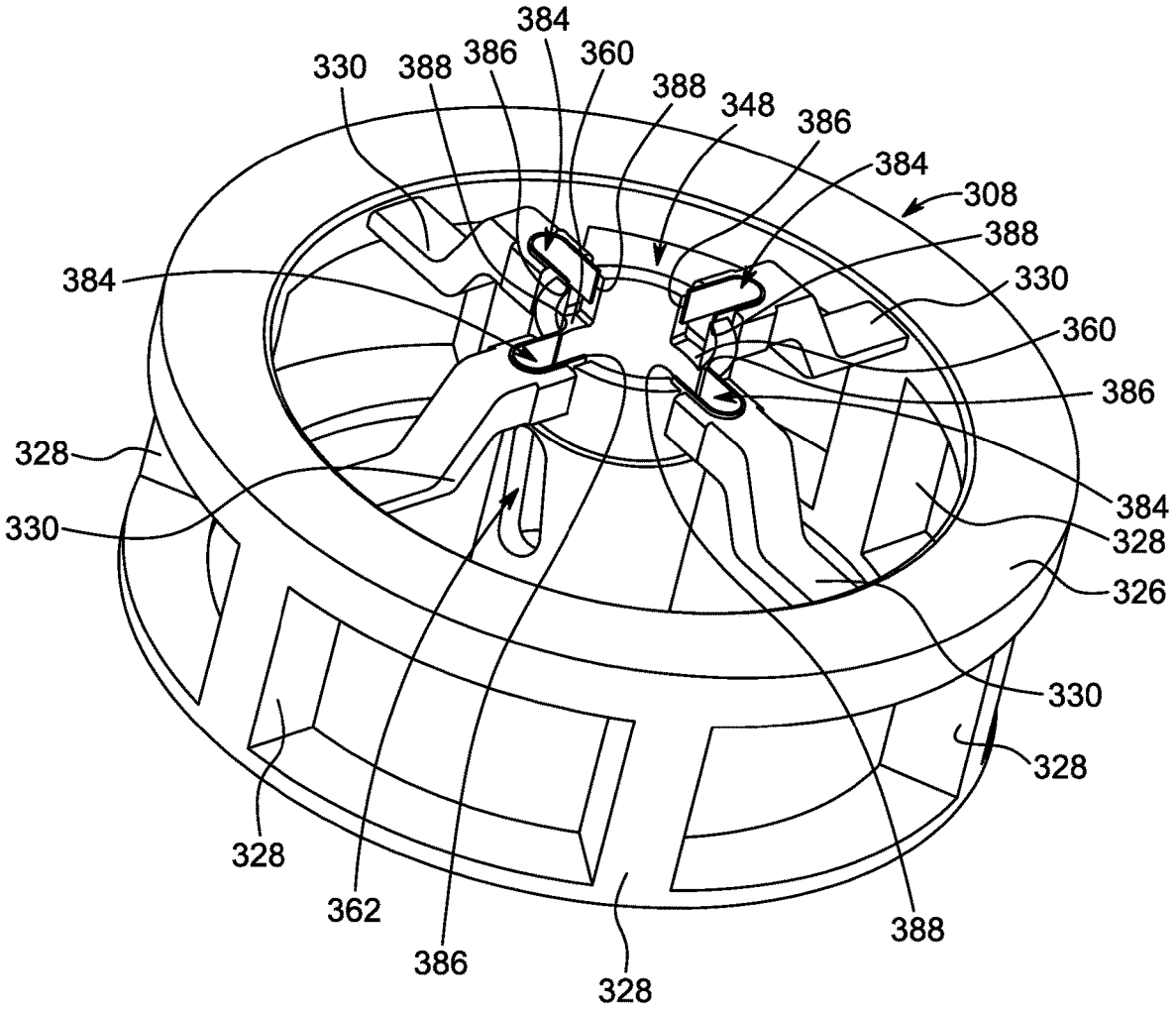
FIG. 14 is a top, front, right isometric view of a cage coupled to the slot tube of FIG. 11 with a compliance mechanism.

FIG. 14 illustrates one non-limiting example of the compliance member 384 in the form of a U-shaped spring coupled between each of the cage arms 330 and the slot tube 348. That is, in the illustrated non-limiting example, a distal end of each of the cage arms 330 may be rotationally coupled to the slot tube 348 through a compliance member 384. Each of the compliance members 384 includes a first end 386 and a second end 388 that extend into the tube slots 360 formed in the slot tube 348 and engage opposing sides of the tube slots 360. In some non-limiting examples, the compliance members 384 may be pre-biased, such that, when the compliance members 384 are installed within the tube slots 368, the first end 386 and the second end 388 are loaded (i.e., generate a force in a direction away from one another) to ensure that any displacement of the slot tube 348 is transferred to the cage 308 through the compliance members 384, and vice versa. For example, if the slot tube 348 is rotated clockwise from the perspective of FIG. 14, the first ends 386 of the compliance members 384 may flex to generate and maintain a biasing force on the cage 308 in the clockwise direction. Since the compliance members 384 are flexible in design, the rotational relationship between cradle rotor 304 and the cage 308 may be provided with a predetermined amount of lash, or relative rotation, which is determined by the physical properties of the compliance members 384 (e.g., spring constant).

For example, if the cradle rotor 304 is subjected to an outside force in a direction while the pin 354 is actuated to the forward phasing region or the backward phasing region, the compliance members 384 may control the amount of relative rotation between the cradle rotor 304 and the stator 302 that occurs prior to locking. That is, the pin 354 may engage the slot 362 and load the cage 308 through the compliance members 384 (i.e., hold the cage 308 in engagement with one of the first locking features 320 and the second locking features 322), but the compliance members 384 may also allow the cradle rotor 304 to rotate relative to the cage 308 to, after a predetermined amount of relative rotation, lock one of the first locking features 320 and the second locking features 322 via compression. Therefore, during each cycle of the outside force applied to the cradle rotor 304, the compliance members 384 may enable the cradle rotor 304 to harvest the outside force in the direction of phasing and rotate relative to the stator 302 a predetermined amount, which is defined by the properties of the compliance members 384, and then stop due to the relative rotation between the cradle rotor 304 and the cage 308 provided by the compliance members 384. In this way, for example, the amount of phasing between the cradle rotor 304 and the stator 302 that occurs during each cycle of the outside force (e.g., cam torque pulse) may be known or predetermined for a given engine speed, position of the pin 354, and design (e.g., spring constant) of the compliance member 384.

In some non-limiting example, the functionality of the compliance member 384 may be provided by designing the cage arms 330 to rotationally flex, rather than providing a separate component (e.g., a spring) between the slot tube 348 and the cage 308.

Figure 15A:
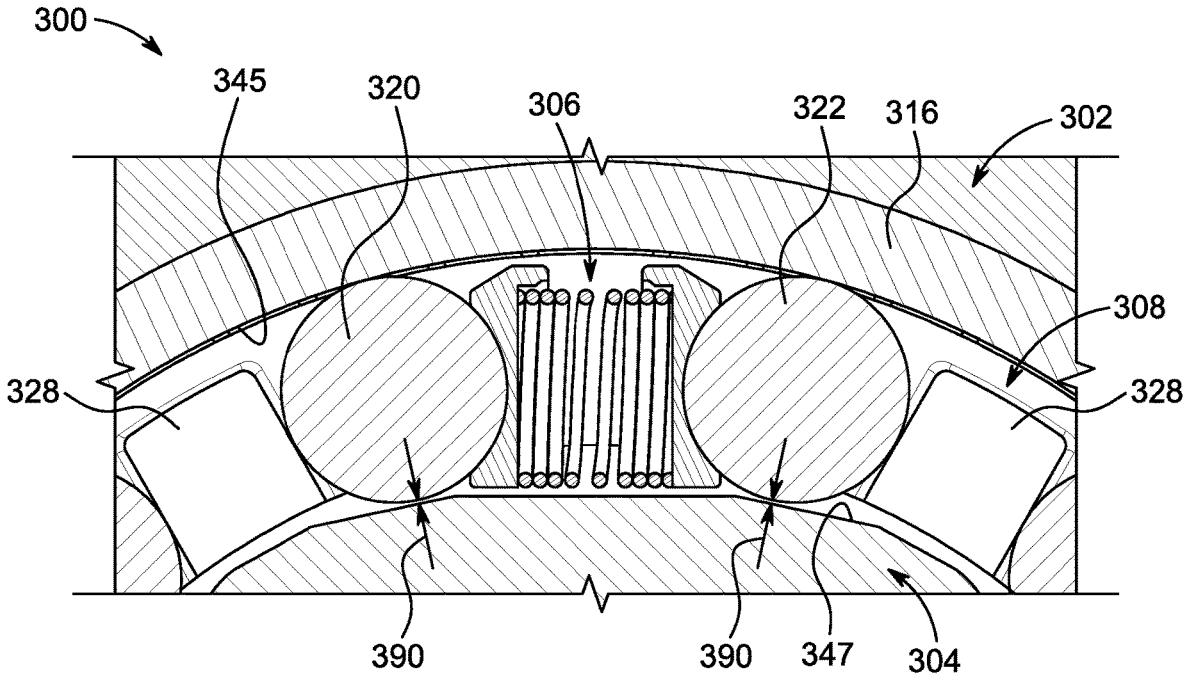
FIG. 15A is an enlarged view of a locking assembly of the cam phasing system of FIG. 13 in an unloaded state.
Figure 15B:
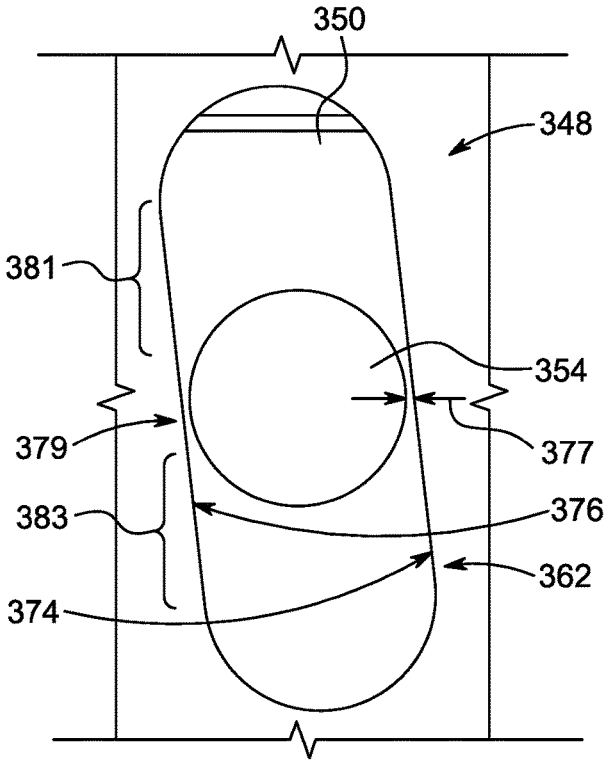
FIG. 15B is an enlarged view of the portion of the slot tube and the pin of FIG. 11 in an unloaded state.

General operation of the cam phasing system 300 including the compliance members 384 will be described with reference to FIGS. 12-22B. As described above with respect to the cam phasing system 300 including the slots 362 of FIG. 9, the cam phasing system 300 with the compliance members 300 and the slots 362 of FIGS. 10 and 11 may provide steady state locking. For example, as illustrated in FIGS. 15A and 15B, when the pin 354 is in the neutral position 379 and the cradle rotor 300 is unloaded (i.e., no outside force applied to the cradle rotor 304), the clearance 377 may be defined between the pin 354 and the slots 362. In addition, the cage protrusions 328 may engage the first locking features 320 and the second locking features 322 to bias them off of at least one of the first mating surface 345 of the stator 302 and the second mating surface 347 of the cradle rotor 304. In the illustrated non-limiting example, the cage protrusions 328 may bias the first locking feature 320 and the second locking feature 322 off of the second mating surface 347 of the cradle rotor 304 and provide a clearance 390 therebetween.

Figure 16A:
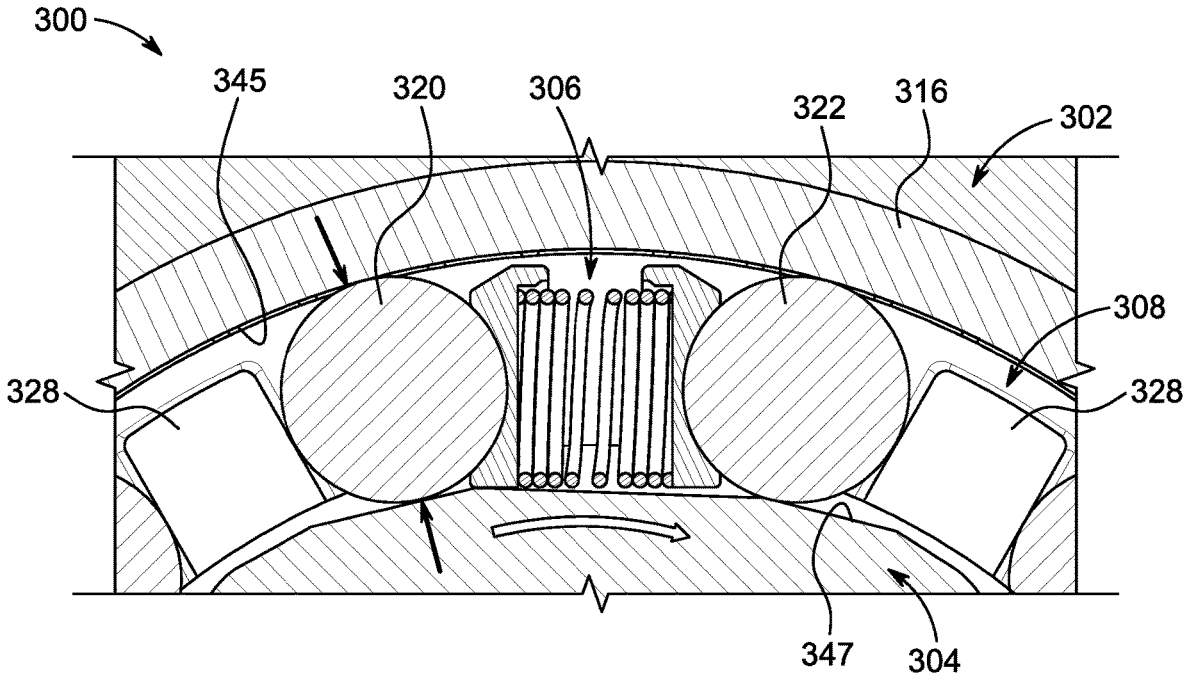
FIG. 16A is an enlarged view of a locking assembly of the cam phasing system of FIG. 13 in a loaded state with an outside force applied in a first direction.
Figure 16B:
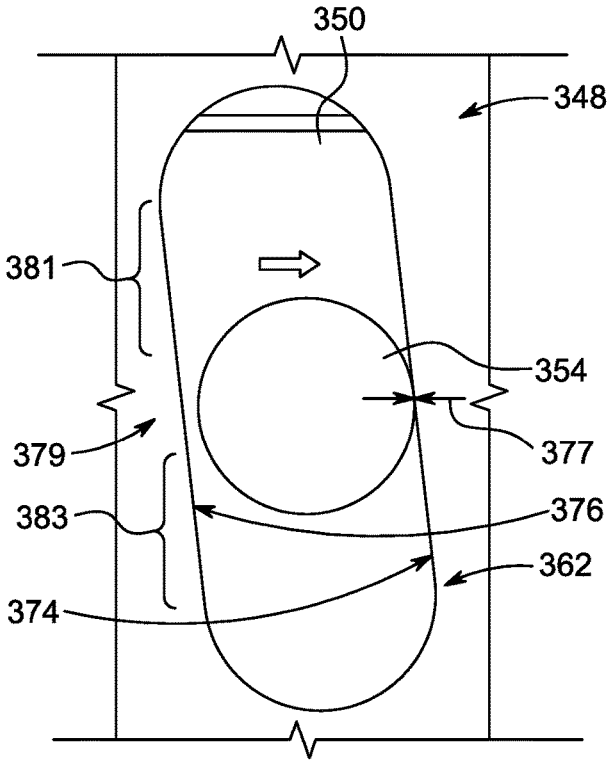
FIG. 16B is an enlarged view of the portion of the slot tube and the pin of FIG. 11 with an outside force applied in a first direction.

Turning to FIGS. 16A and 16B, when an outside force (e.g., a cam torque pulse) acts on the cradle rotor 304 in a first direction (e.g., clockwise from the perspective of FIG. 16A), the cradle rotor 304, and the second mating surface 347, may rotate relative to the stator 302, which compresses and loads the first locking features 320 between the first mating surface 345 and the second mating surface 347. At the same time, the pin 354 may move laterally within the slot 362, due to the rigid rotational coupling between the pin 354 and the cradle rotor 304, toward the first side 374 of the slot 362, but does not engage the first side 374 of the slot 362 (i.e., some of the clearance 377 remains between the slot 362 and the pin 354). In this way, for example, the compression of the first locking features 320 may prevent relative rotation between the cradle rotor 304 and the stator 302 in the first direction.

Figure 17A:
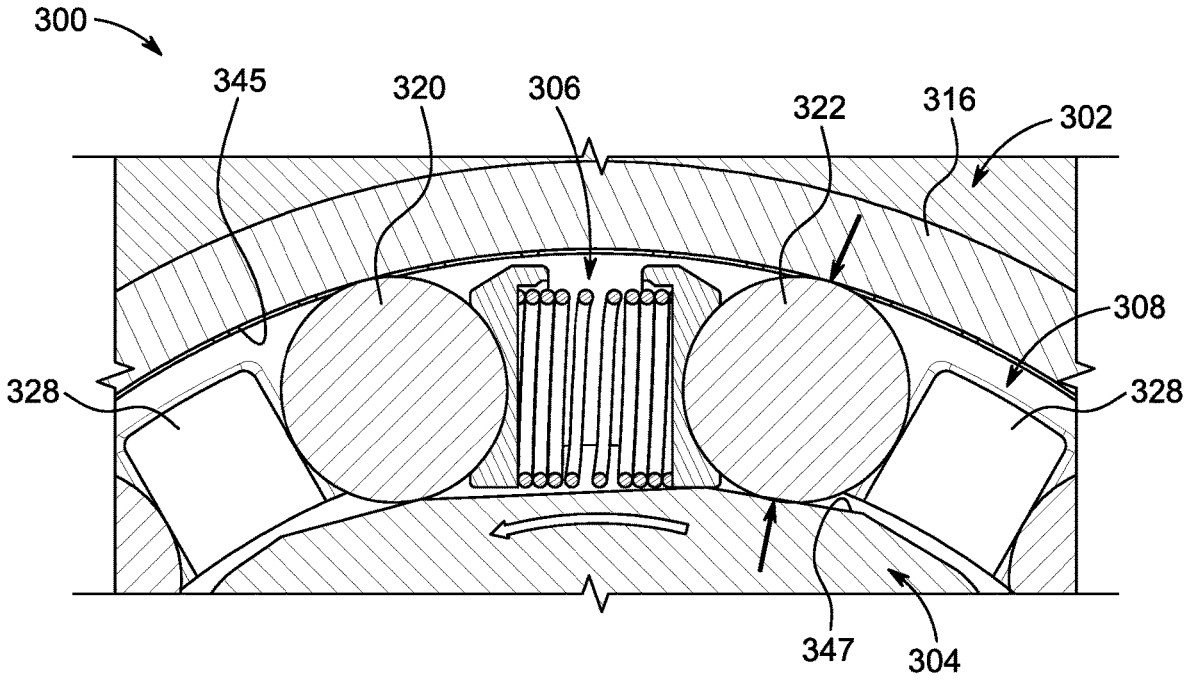
FIG. 17A is an enlarged view of a locking assembly of the cam phasing system of FIG. 13 in a loaded state with an outside force applied in a second direction.
Figure 17B:
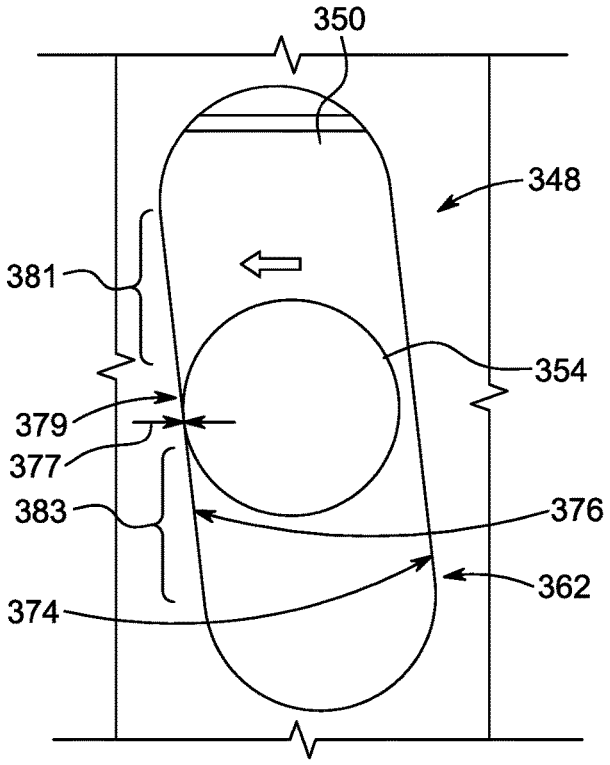
FIG. 17B is an enlarged view of the portion of the slot tube and the pin of FIG. 11 with an outside force applied in a second direction.

Turning to FIGS. 17A and 17B, when an outside force (e.g., a cam torque pulse) acts on the cradle rotor 304 in a second direction (e.g., counterclockwise from the perspective of FIG. 17A), the cradle rotor 304, and the second mating surface 347, may rotate relative to the stator 302, which compresses the second locking features 322 between the first mating surface 345 and the second mating surface 347. At the same time, the pin 354 may move laterally within the slot 362, due to the rigid rotational coupling between the pin 354 and the cradle rotor 304, toward the second side 376 of the slot 362, but does not engage the second side 376 of the slot 362 (i.e., some of the clearance 377 remains between the slot 362 and the pin 354). In this way, for example, the compression of the second locking features 322 may prevent relative rotation between the cradle rotor 304 and the stator 302 in the second direction. As such, when the pin 354 is in the neutral position 379, the cam phasing system 300 may be in a locked state and relative rotation between the cradle rotor 304 and the stator 302 may be inhibited.

To initiate a phase change (i.e., a change in relative rotational orientation) between the cradle rotor 304 and the stator 302, a current may be applied to the solenoid 356 that displaces the pin 354 to one of the forward phasing region 381 or the backward phasing region 383. The following description references displacing the pin 354 to the backward phasing region 383, and it should be appreciated that the opposite process may occur for displacing the pin to the forward phasing region 381.

Figure 18A:
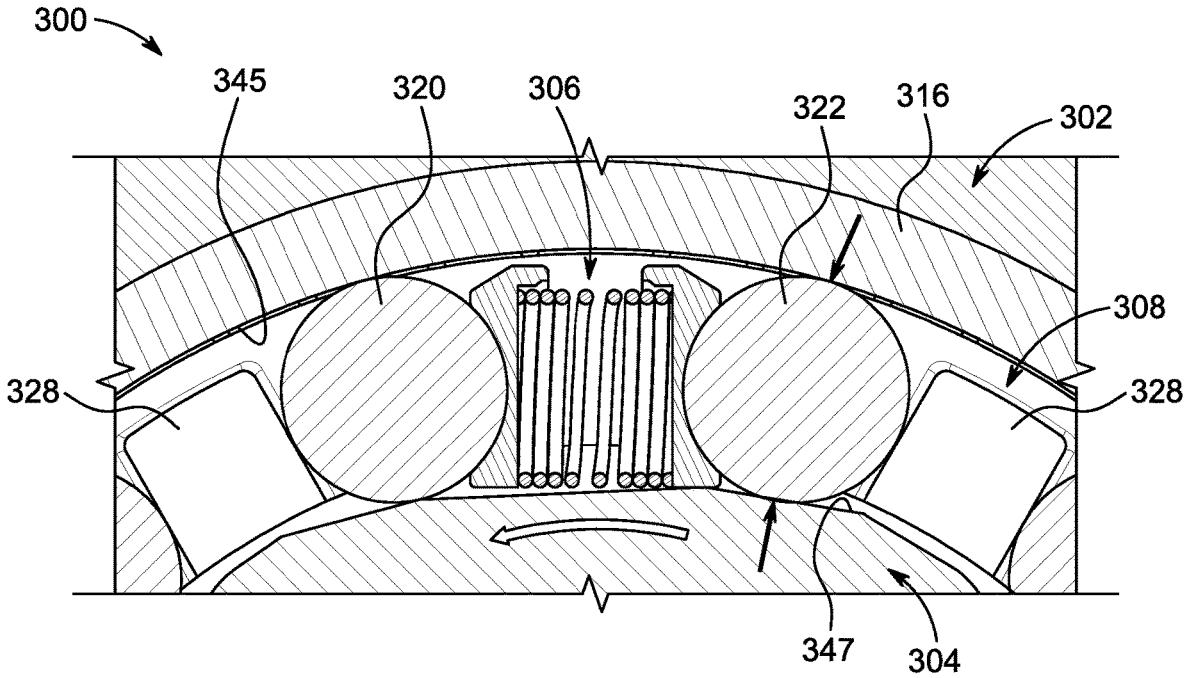
FIG. 18A is an enlarged view of a locking assembly of the cam phasing system of FIG. 13 in a loaded state with an outside force applied in a second direction.
Figure 18B:
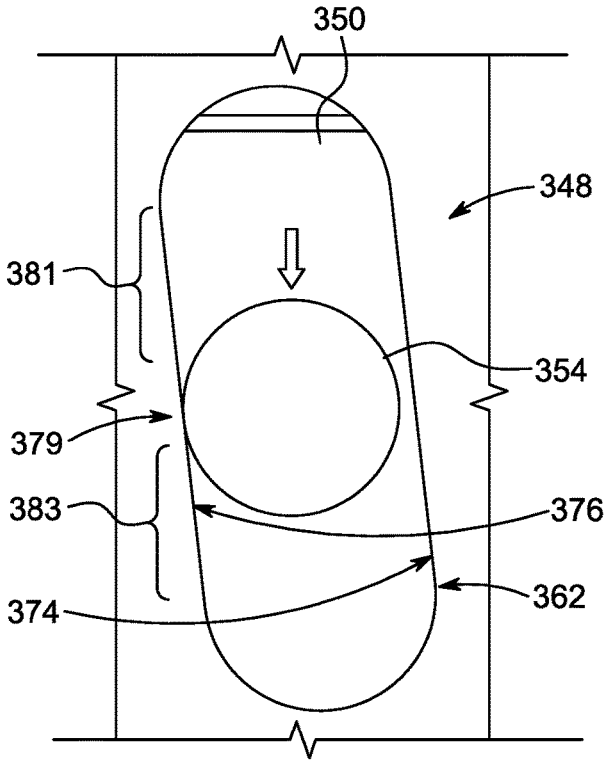
FIG. 18B is an enlarged view of the portion of the slot tube and the pin of FIG. 11 with an outside force applied in a second direction and a force applied to the pin.

In the illustrated non-limiting example of FIGS. 18A and 18B, the solenoid 356 may apply a force to displace the pin 354 from the neutral position 379 to the backward phasing position 383. In some non-limiting examples, a force may be applied to the pin 354 when the cradle rotor 304 is loaded (i.e., a cam torque pulse is acting thereon). As illustrated in the non-limiting example of FIG. 18A, the force may be applied to the pin 354 when an outside force (e.g., cam torque pulse in a second direction, or counterclockwise from the perspective of FIG. 18A) is simultaneously applied to the cradle rotor 304 in the second direction. The outside force acting on the cradle rotor 304 may displace cradle rotor 304 relative to the stator 302 and lock the second locking features 322 via compression. The second locking features 322 being locked may prevent the cage protrusions 328, and thereby the cage 308, from rotating relative to the cradle rotor 304 and also prevent the pin 354 from displacing axially along the slot 362. For example, the pin 354 may engage the second side 376 of the slot 362 prior to reaching the backward phasing region 383 and be prevented from displacing further due to relative rotation between the cage 308 and the cradle rotor 304 being inhibited by the second locking features 322 being locked.

Figure 19A:
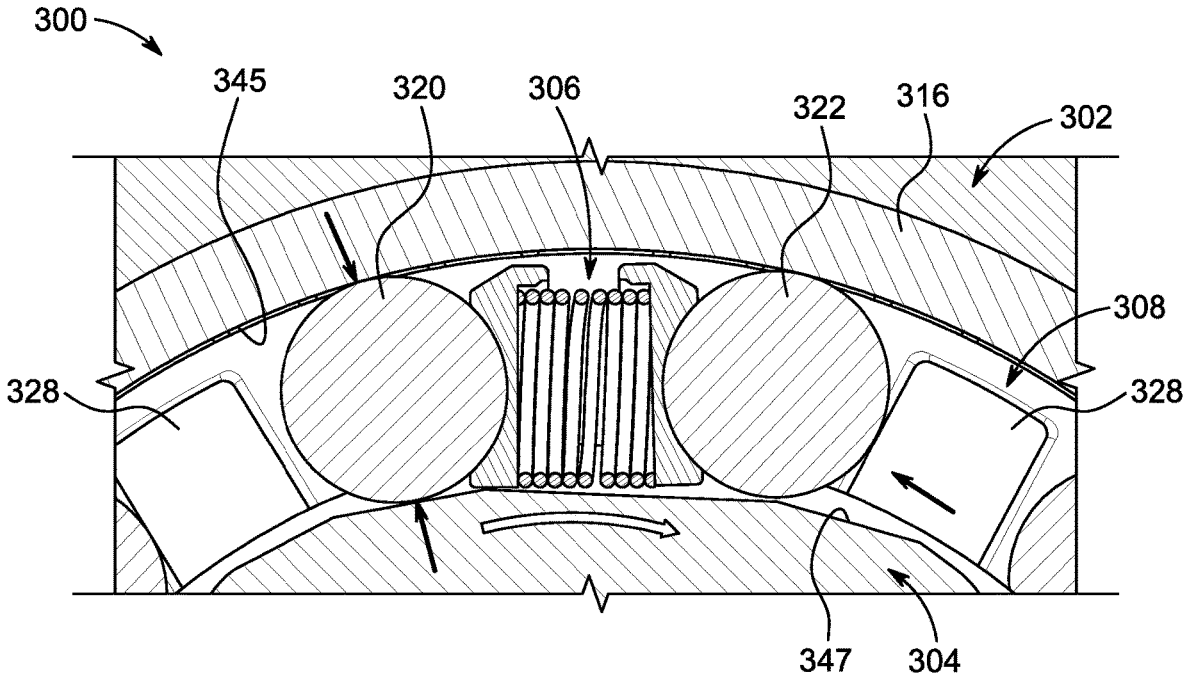
FIG. 19A is an enlarged view of a locking assembly of the cam phasing system of FIG. 13 in a loaded state with an outside force applied in a first direction.
Figure 19B:
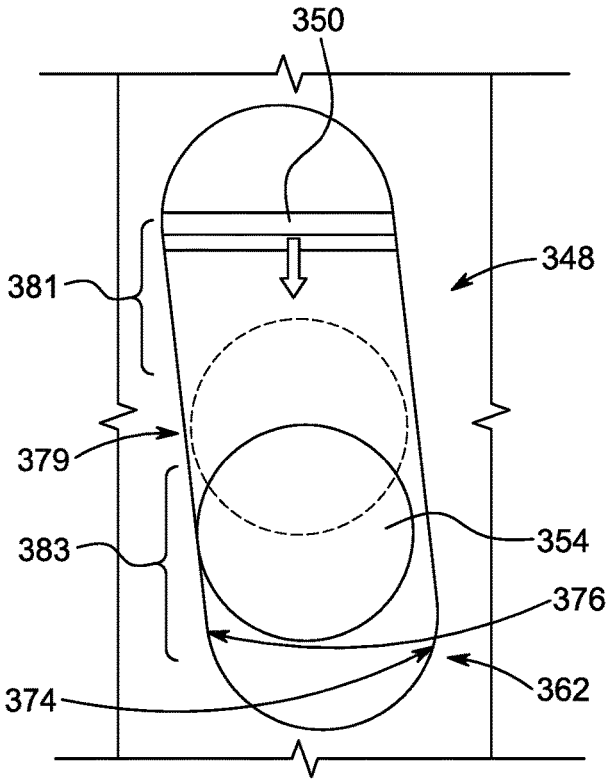
FIG. 19B is an enlarged view of the portion of the slot tube and the pin of FIG. 11 with an outside force applied in a first direction and a force displacing the pin.

The pin 354 and the cage 308 may be prevented from moving due to the second locking features 322 being locked until the outside force reverses (e.g., from a direction that favors phasing to a direction that opposes phasing, or from a second direction to a first direction). As illustrated in FIGS. 19A and 19B, when the outside force is applied in a first direction, the second locking features 320 unlock, and the first locking features 320 are locked via compression, which prevents relative rotation between the cradle rotor 304 and the stator 302 in the first direction. In addition, the cage 308 is now allowed to, and does, rotate relative to the cradle rotor 304 in the second direction, and the force applied to the pin 354 displaces the pin 354 to the backward phasing region 383. The relative rotation between the cradle rotor 304 and the cage 308 brings the cage protrusions 328 into engagement with the second locking features 322 to displace the second locking features 322 relative to the cradle rotor 304 in the second direction and bias the second locking features 322 away from at least one of the first mating surface 345 and the second mating surface 347, thereby unlocking the second locking features 322.

Figure 20A:
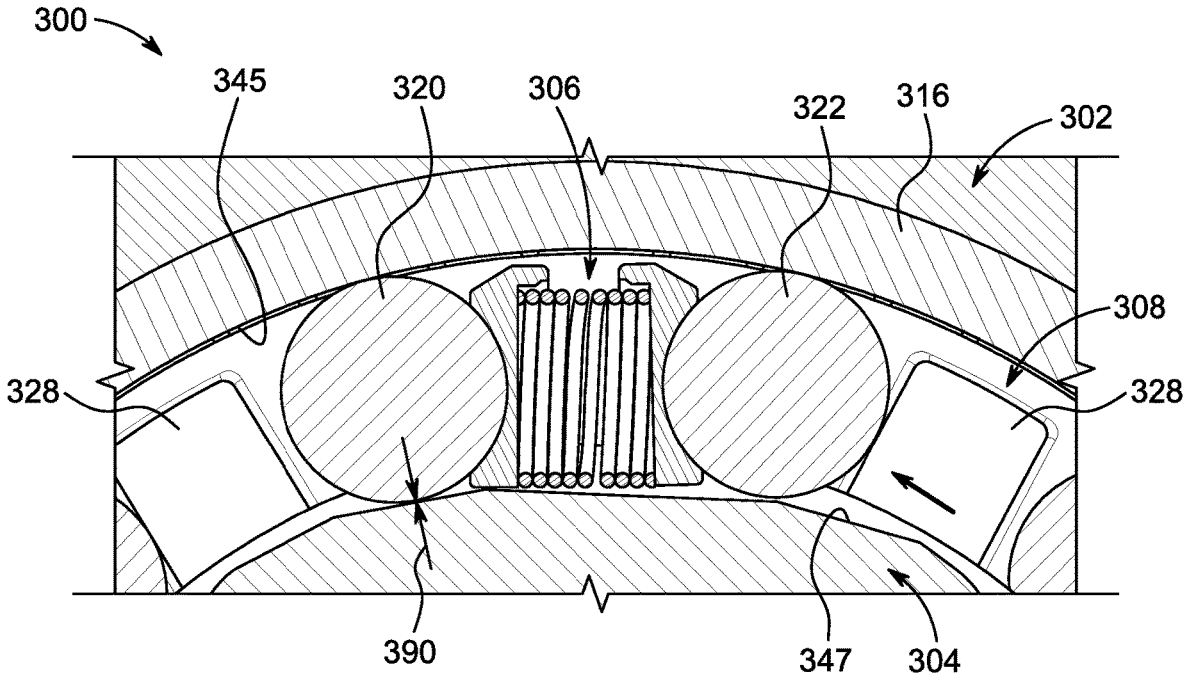
FIG. 20A is an enlarged view of a locking assembly of the cam phasing system of FIG. 13 in an unloaded state.
Figure 20B:
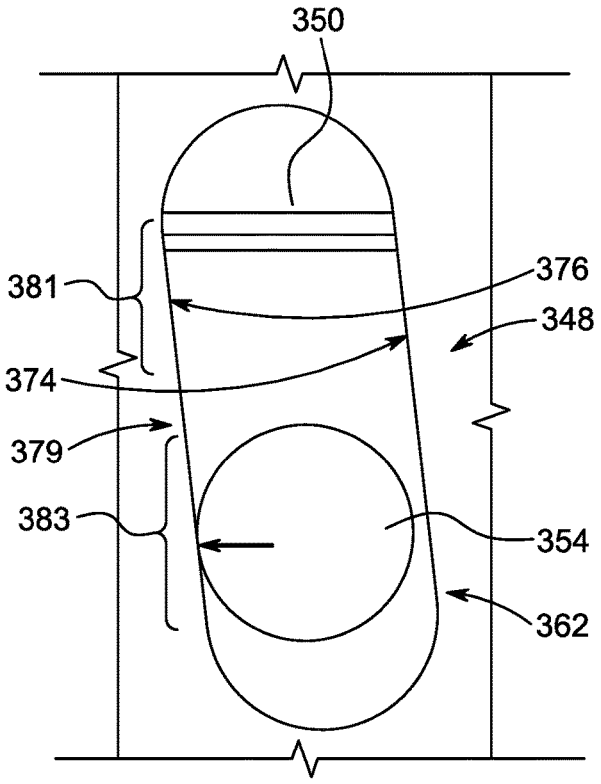
FIG. 20B is an enlarged view of the portion of the slot tube and the pin of FIG. 11 in an unloaded state and the pin displaced.

As the outside force applied to the cradle rotor 304 again begins to reverse (e.g., from a direction that opposes phasing to a direction that favors phasing, or from a first direction to a second direction), the cam phasing system 300 may pass through the unloaded state (i.e., the magnitude of the cam torque pulses may pass through zero). As illustrated in FIGS. 20A and 20B, as the system passes through unloaded state, the pin 354 may engage the second side 376 of the slot 362, which results in the cage protrusions 328 continuing to displace the second locking features 322 in the second direction relative to the cradle rotor 304 and the stator 302. The relative motion between the second locking features 322 and the cradle rotor 304 caused by the engagement between the pin 354 and the slot 362 enables a change in the relative rotational orientation between the cradle rotor 304 and the stator 302. In addition, during the transition through the unloaded state, the compression of the first locking features 320 may be removed and the clearance 390 may again be defined between the first locking features 390 and at least one of the first mating surface 345 and the second mating surface 347.

Figure 21A:
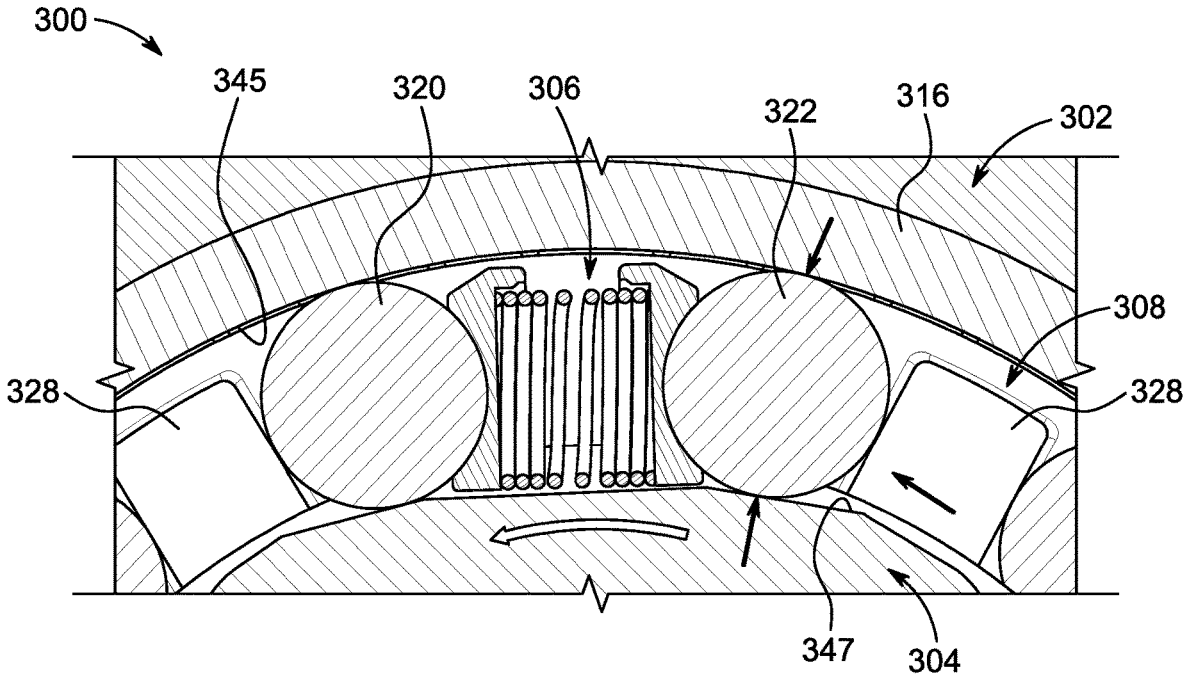
FIG. 21A is an enlarged view of a locking assembly of the cam phasing system of FIG. 13 in a loaded state with an outside force applied in a second direction.
Figure 21B:
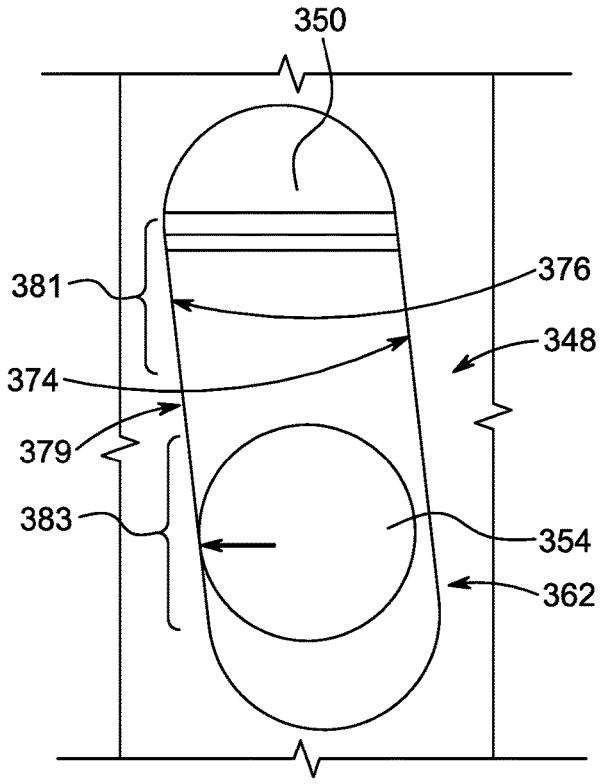
FIG. 21B is an enlarged view of the portion of the slot tube and the pin of FIG. 11 with an outside force applied in a second direction and the pin displaced.

Once the cam phasing system 300 transitions through the unloaded state and the outside force is again acting in a direction that favors phasing (e.g., a second direction, or counterclockwise from the perspective of FIG. 21A), the cradle rotor 304 may harvest the outside force and rotate in the direction of the outside force relative to the stator 302. As illustrated in FIGS. 21A and 21B, the relative rotation between the second locking features 322 and the cradle rotor 304 provided by the cage 308 may enable the cradle rotor 304 to harvest the outside force and rotate in the second direction relative to the stator 302. The cradle rotor 304 may continue to rotate relative to the stator 302 in the second direction until the second locking features 322 are locked via compression, which prevents further rotation of the cradle rotor 304.

The locking of the second locking features 322 is enabled by the lash or relative rotation allowed by the compliance members 384 between the cradle rotor 304 and the cage 308. For example, the outside force in the second direction applied to the cradle rotor 304 may be applied to the pin 354 due to the rigid rotational coupling therebetween. This force biases the pin 354 against the second side 376 of the slot 362, which biases the cage 308, and thereby the second locking features 322 via engagement with the cage protrusions 328, in the second direction through the compliance members 384. As the pin 354 continues to be forced into the slot 362 by the cradle rotor 304, the compliance members 384 may flex rotationally to maintain the load on the pin 354 and the cage 308 from the cradle rotor 304 and allow the cradle rotor 304 to rotate relative to the cage 308. The compliance members 384 may provide enough lash or relative rotation between the cradle rotor 304 and the cage 308 to allow the cradle rotor 304 reach a rotational position where the second locking features 322 are locked via compression between the first mating surface 345 and the second mating surface 347. For example, the cradle rotor 304 may rotate faster (due to the coupling to the camshaft) than the biasing force from the compliance members 384 can accelerate the cage 308. This allows the cage 308 to initially displace the second locking features 322 relative to the cradle rotor 304 and then for the cradle rotor 304 to catch up and lock the second locking features 322, which results in the cradle rotor 304 rotating relative to the stator 302 and then locking once the second locking features 322 are compressed by the cradle rotor 304.

Once the second locking features 322 are locked via compression, further phasing between the cradle rotor 304 and the stator 302 may be prevented, but the cage 308 and the pin 354 may remain loaded in the second direction through the compliance members 384. Therefore, the compliance members 384 may control the amount of relative rotational motion between the cradle rotor 304 and the stator 302 that is harvested during each cycle of the outside force (e.g., cam torque cycle).

Figure 22A:
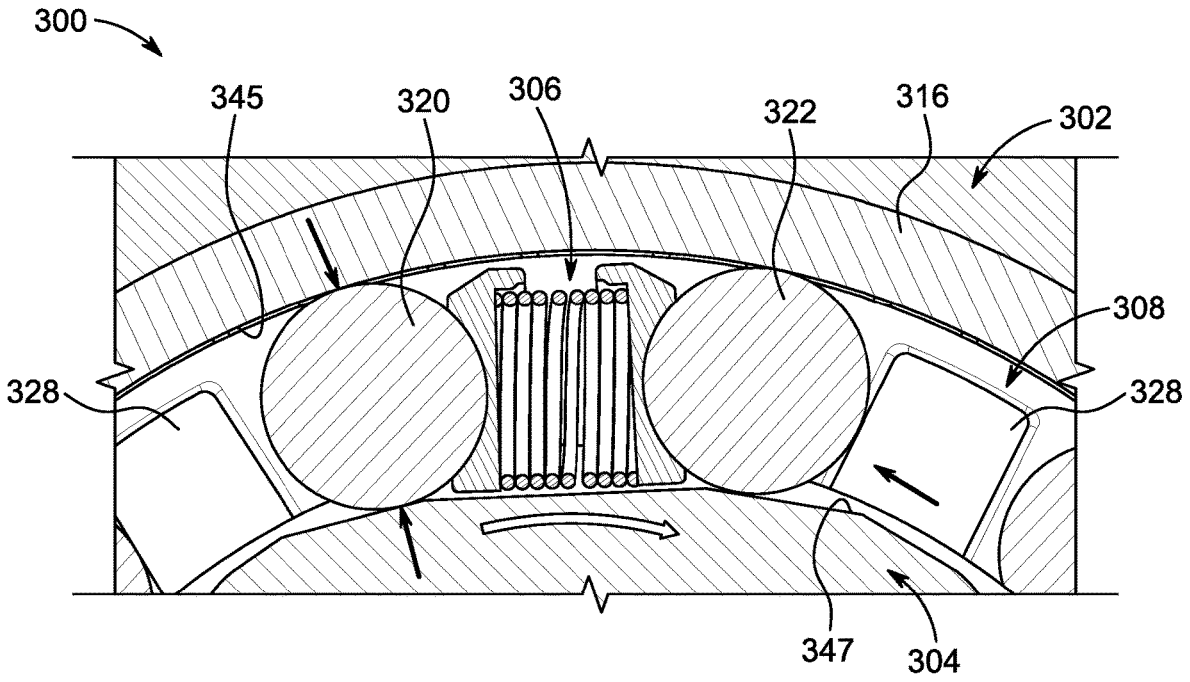
FIG. 22A is an enlarged view of a locking assembly of the cam phasing system of FIG. 13 in a loaded state with an outside force applied in a first direction.
Figure 22B:
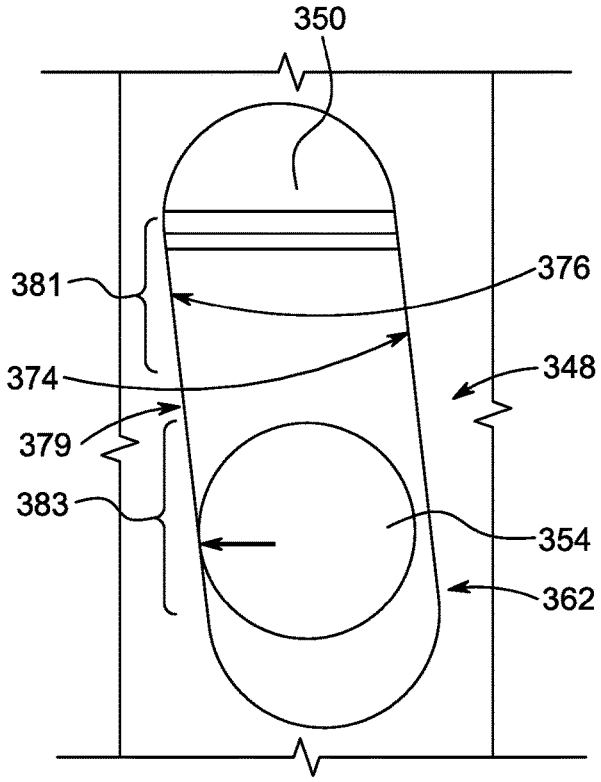
FIG. 22B is an enlarged view of the portion of the slot tube and the pin of FIG. 11 with an outside force applied in a first direction and the pin displaced.

Turning to FIGS. 22A and 22B, the cam phasing system 300 will continue to harvest portions of the outside force that occur in the phasing direction (e.g., the second direction) until the pin 354 is displaced to a different region along the slot 362. For example, as illustrated in FIGS. 22A and 22B, once the outside force again reverses to the first direction (e.g., the direction opposing phasing) with the pin 354 displaced to the backward phasing region 383, the load on the pin 354 applied through the compliance members 384 from the cradle rotor 304 may be removed, but the pin 354 stays in position. In this way, for example, the cradle rotor 304 may be allowed to rotate in the first direction to lock the first locking features 320 via compression, which may result in the respective cage protrusions 328 holding the second locking features 322 in place. From this position, the cam phasing system 300 may continue to harvest outside forces applied to the cradle rotor 304 in the second direction to rotate the cradle rotor 304 relative to the stator 302 in the second direction, until the position of the pin 354 is changed.

Figure 23:
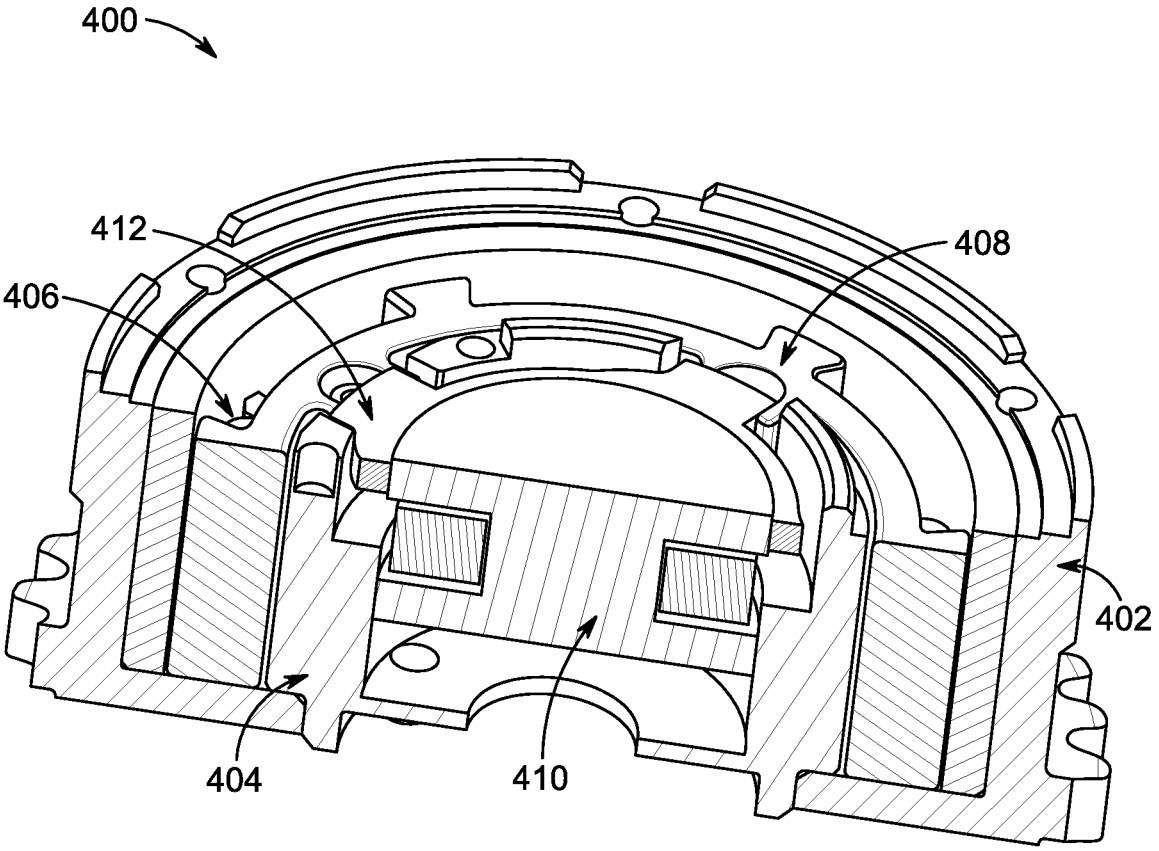
FIG. 23 is a cross-sectional view of a mechanical cam phasing system including an internal solenoid according to one aspect of the present disclosure.

In the mechanical cam phasing system 300 described herein, the solenoid 356 is arranged externally from the stator 302 and is configured to apply a linear displacement to the plunger 350. In some non-limiting examples, a pin may be placed in a slot or hole for each direction of motion as schematically illustrated in FIGS. 2A-2C, instead of the slot tube configuration described herein. This may require two solenoids to unlock (i.e., one for each desired direction of phasing). In some non-limiting examples, a solenoid may be arranged within the stator 302 and/or may be configured to apply a rotational input displacement to transition the relative rotation between the cradle rotor 304 and the stator 302 between the locked state and the unlocked state. FIG. 23 illustrates one non-limiting example of a mechanical cam phasing system 400 that may include a stator 402, a cradle rotor 404, and a plurality of locking assemblies 406, a cage 408, and a solenoid 410. The stator 402 may be rotationally coupled to a crankshaft. The locking assemblies 406 may be similar to the first locking assemblies 306 in design and operation. The cage 408 may be designed structurally different than the cage 308, but the principles of operation may be similar (e.g., provide a predetermined interference on the locking assemblies).

When assembled, the solenoid 410 may be arranged internally within the stator 302. In some non-limiting examples, the solenoid 410 may be coupled to a front cover (not shown) of the mechanical cam phasing system 400 and may not rotate with the cradle rotor 404. The cradle rotor 404 may be rotationally coupled to a camshaft. The mechanical cam phasing system 400 may include a rotor insert 412. The rotor insert 412 may be rigidly attached to the cage 408.

In operation, when the solenoid is activated, rotational forces may be applied between the rotor insert 412 and the cradle rotor 404 in a tangential direction, which may lead to unlocking of the relative rotation between the cradle rotor 404 and the stator 402 in a desired direction. That is, rigidly coupling the rotor insert 412 and the cage 408 may pull the cradle rotor 404 and the cage 408 together in response to the rotational input force provided by the solenoid 410 in a desired direction.

The mechanical cam phasing systems 300, 400 described herein leverage the interference concept to selectively enable relative rotation between a camshaft and a crankshaft in a desired direction. In this way, for example, the mechanical cam phasing systems 300, 400 may provide significant benefits over conventional cam phasing systems. For example, the mechanical cam phasing systems 300, 400 may provide functionality at startup/shutdown of the internal combustion engine and during cold conditions, providing significant benefits when compared with conventional oil-based cam phasing systems. In addition, the simplified actuation of the mechanical cam phasing systems 300, 400 and the low input force requirements to facilitate the relative rotation between the camshaft and the crankshaft provide a low-cost solution when compared to conventional cam phasing systems (e.g., costs may be lower than conventional oil-based systems and significantly lower than conventional electronic cam phasing systems (e-phasing systems)). Further, the mechanical cam phasing systems 300, 400 may be capable of locking in any relative position between the camshaft and the crankshaft. That is, there are no restrictions to the magnitude of phasing allowed between the camshaft and the crankshaft, and full three-hundred and sixty degree phasing is achievable.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A mechanical cam phasing system for an internal combustion engine having a crankshaft and a camshaft, the mechanical cam phasing system comprising:

a stator rotationally coupled to the crankshaft and including a first mating surface;

a cradle rotor rotationally coupled to the camshaft and including a second mating surface;

a first locking mechanism including a first locking feature and a second locking feature;

a cage; and a second locking mechanism rotationally coupled to the cradle rotor and configured to selectively moveable between a locking state and a phasing state, where in the locking state, a clearance is provided between the cradle rotor and the cage, and where in the phasing state, the clearance is reduced so as to ensure a rotational coupling between the cradle rotor and the cage in at least one direction, wherein the second locking mechanism is configured to transition between the locking state and the phasing state in response to an input displacement applied to the second locking mechanism, and wherein the rotational coupling is configured to displace the first locking feature or the second locking feature relative to the cradle rotor and enable the cradle rotor to rotate relative to the stator, and wherein the second locking mechanism includes:

a slot tube rotationally coupled to the cage through one or more compliance members and including a slot extending axially along a portion of the slot tube, wherein the slot defines a locking region and one or more phasing regions axially separated from the locking region;

a plunger slidably received within the slot tube;

a pin extending through the plunger and the slot, the pin being rotationally coupled to the cradle rotor; and a solenoid configured to selectively displace the plunger and thereby the pin along the slot.

2. The mechanical cam phasing system of claim 1, wherein, when the cradle rotor is unloaded and the second locking mechanism is in the locking state, the cage engages the first locking feature and the second locking feature so as to bias the first locking feature and the second locking feature out of engagement with at least one of the first mating surface and the second mating surface, and wherein, when the cradle rotor is loaded by an outside force in a first direction and the second locking mechanism is in the locking state, the clearance allows the cradle rotor to rotate in the first direction and compress the first locking feature between the first mating surface and the second mating surface.

3. The mechanical cam phasing system of claim 1, wherein, when the cradle rotor is loaded by an outside force and the second locking mechanism is in the phasing state, the cage engages and displaces at least one of the first locking feature or the second locking feature relative to the cradle rotor.

4. The mechanical cam phasing system of claim 1, wherein, when the pin is in the locking region, the second locking mechanism is in the locking state, and when the pin is displaced to one of the one or more phasing regions by the solenoid, the second locking mechanism transitions from the locking state to the phasing state.

5. The mechanical cam phasing system of claim 1, wherein the one or more compliance members are each in a form of a spring coupled between the cage and the slot tube.

6. The mechanical cam phasing system of claim 5, wherein the one or more compliance members are configured to allow a predetermined amount of relative rotation between the cradle rotor and the cage in the phasing state.

7. A mechanical cam phasing system for an internal combustion engine having a crankshaft and a camshaft, the mechanical cam phasing system comprising:

a stator rotationally coupled to the crankshaft;

a cradle rotor rotationally coupled to the camshaft;

a locking assembly including a first locking feature and a second locking feature;

a cage;

an actuation assembly including:

a slot tube rotationally coupled to the cage through one or more compliance members and including a slot extending axially along a portion of the slot tube, wherein the slot defines a locking region and one or more phasing regions axially separated from the locking region;

a plunger slidably received within the slot tube;

a pin extending through the plunger and the slot, the pin being rotationally coupled to the cradle rotor for rotation therewith;

a solenoid configured to selectively displace the plunger and thereby the pin along the slot, wherein the solenoid is configured to selectively displace the pin from the locking region to one of the one or more phasing regions, which, in turn, transitions a rotational relationship between the stator and the cradle rotor from a locked state where relative rotation is inhibited to an unlocked state where relative rotation is enabled.

8. The mechanical cam phasing system of claim 7, wherein the cradle rotor includes at least one pin slot radially recessed into an inner surface of the cradle rotor and extending in an axial direction of the cradle rotor, and wherein an end of the pin is received within the pin slot so as to rotationally couple the pin to the cradle rotor.

9. The mechanical cam phasing system of claim 7, wherein a clearance between the pin and the slot, when the pin is in the locking region, allows the cradle rotor to rotate relative to the cage and lock the first locking feature or the second locking feature by compression between the stator and the cradle rotor.

10. The mechanical cam phasing system of claim 9, wherein, when the cradle rotor is unloaded and the pin is in the locking region, the cage engages the first locking feature and the second locking feature so as to bias the first locking feature and the second locking feature out of engagement with at least one of the cradle rotor and the stator, and wherein, when the cradle rotor is loaded by an outside force in a first direction and the pin is in the locking region, the clearance allows the cradle rotor to rotate in the first direction and compress the first locking feature between the cradle rotor and the stator.

11. The mechanical cam phasing system of claim 7, wherein displacing the pin from the locking region to one of the one or more phasing regions reduces a clearance between one side of the slot and the pin so as to ensure a rotational coupling between the cradle rotor and the cage.

12. The mechanical cam phasing system of claim 11, wherein the rotational coupling brings the cage into engagement with at least one of the first locking feature and the second locking feature so as to displace the at least one of the first locking feature and the second locking feature relative to the cradle rotor.

13. The mechanical cam phasing system of claim 12, wherein the one or more compliance members are configured to allow a predetermined amount of relative rotation between the cradle rotor and the cage when the pin is displaced to one of the one or more phasing regions.

14. The mechanical cam phasing system of claim 13, wherein the predetermined amount of relative rotation allows the at least one of the first locking feature and the second locking feature to lock via compression between the cradle rotor and the stator after the at least one of the first locking feature and the second locking feature is displaced relative to the cradle rotor.

15. The mechanical cam phasing system of claim 7, wherein the one or more compliance members are each in a form of a spring coupled between the cage and the slot tube.

16. A method for adjusting a rotational relationship between a camshaft and a crankshaft on an internal combustion engine, the camshaft rotationally coupled to a cradle rotor and the crankshaft rotationally coupled to a stator, the method comprising:

providing a predetermined interference to a locking assembly via engagement with a cage, wherein the predetermined interference displaces the locking assembly out of engagement with at least one of the stator and the cradle rotor when the cradle rotor is in an unloaded state;

actuating a solenoid so as to displace a plunger received within a slot tube to a predetermined position, wherein the slot tube is rotationally coupled to the cage through one or more compliance members and includes a slot extending axially along a portion of the slot tube, wherein the slot defines a locking region and one or more phasing regions axially separated from the locking region, and wherein a pin extends through the plunger and the slot tube and is rotationally coupled to the cradle rotor;

displacing the pin to one of the one or more locking regions so as to provide a force between the cradle rotor and the cage such that the cage is maintained in engagement with the locking assembly and the locking assembly is biased relative to the cradle rotor in one direction; and adjusting the rotational relationship between the cradle rotor and the stator in the one direction during the biasing of the locking assembly.

* * * * *